US011470974B2

(12) United States Patent
Lan

(10) Patent No.: US 11,470,974 B2
(45) **Date of Patent: *Oct. 18, 2022**

(54) YOGA STOOL

(71) Applicant: WeMesh, LLC, Los Angeles, CA (US)

(72) Inventor: Lou Lan, Los Angeles, CA (US)

(73) Assignee: WeMesh, LLC, Los Angeles, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/164,436

(22) Filed: Feb. 1, 2021

(65) Prior Publication Data

US 2021/0153662 A1 May 27, 2021

Related U.S. Application Data

(63) Continuation of application No. 16/295,754, filed on Mar. 7, 2019, now Pat. No. 10,905,243, which is a (Continued)

(51) Int. Cl.
*A47C 9/00* (2006.01)
*A47C 9/10* (2006.01)

(Continued)

(52) U.S. Cl.
CPC ..... *A47C 9/002* (2013.01); *A47C 3/16* (2013.01); *A61H 15/00* (2013.01);

(Continued)

(58) Field of Classification Search
CPC ..... A47C 9/002; A47C 31/00; A61H 15/00; A61H 2015/0014; A61H 2201/0149; A61H 2205/12

(Continued)

(56) References Cited

U.S. PATENT DOCUMENTS 1,429,651 A 9/1922 Slaght
2,108,241 A 2/1938 Leta (Continued)

FOREIGN PATENT DOCUMENTS

CN 202354956 U 8/2012
CN ZL201530086575.5 4/2015
DE 4414096 9/1994

OTHER PUBLICATIONS

International Search Report and Written Opinion dated Apr. 28, 2020 issued in corresponding PCT Application No. PCT/US2020/021439.

(Continued)

*Primary Examiner* — Rodney B White
(74) *Attorney, Agent, or Firm* — Amster, Rothstein & Ebenstein LLP

(57) ABSTRACT

A yoga or exercise stool may have a seat portion and a base portion; the base portion having window slot(s) formed in a front side, a rear side, or both; a handle slot formed at least in one side, such as the front side, at or near the top; horizontal gripping slot(s) formed in the left side, the right side, or both, at or near the top; and vertical gripping slot(s) formed in the left side, the right side, or both, at or near the bottom; advantageously four such slots being formed near the bottom corners of the left and right sides. A yoga stool also may have a base portion, and a seat portion on top of the base portion, wherein the seat portion has an internal firm support member such as a solid slat, and preferably softer material such as foam rubber surrounding the support member, at least on the left and right sides. The yoga stool may include opposed side elements joined by a rear element and front element with a removable top element that may be U-Shaped to allow for additional poses or exercises.

17 Claims, 24 Drawing Sheets

Related U.S. Application Data continuation-in-part of application No. 14/950,536, filed on Nov. 24, 2015, now Pat. No. 10,251,488.

(60) Provisional application No. 62/084,121, filed on Nov. 25, 2014.

(51) Int. Cl.
*A61H 15/00* (2006.01)
*A47C 3/16* (2006.01)

(52) U.S. Cl.
CPC ..... *A61H 2015/0014* (2013.01); *A61H 2201/0149* (2013.01); *A61H 2205/12* (2013.01)

(58) Field of Classification Search
USPC ..... 297/1, 3, 183.1, 183.6, 188.08, 423.39, 297/423.41, 462; 482/142, 148
See application file for complete search history.

(56) References Cited

U.S. PATENT DOCUMENTS

| | | | | |
|---|---|---|---|---|
| D131,473 | S | 3/1942 | Thelander | |
| 2,327,288 | A | 3/1943 | Post | |
| D151,983 | S | 12/1948 | Guertin | |
| 2,509,395 | A | 5/1950 | Madan | |
| 2,532,863 | A | 12/1950 | Auburn | |
| 2,577,741 | A | 12/1951 | Creveling et al. | |
| 2,607,946 | A | 8/1952 | Price | |
| 2,725,923 | A | 12/1955 | Bachrach | |
| 2,776,700 | A | 1/1957 | Potter | |
| 2,877,830 | A | 3/1959 | Smith | |
| 3,077,347 | A | 2/1963 | Nova | |
| 3,099,398 | A | 7/1963 | Croteau | |
| 3,890,004 | A | 6/1975 | Rail | |
| 3,982,784 | A | 9/1976 | Esser | |
| 4,133,524 | A | 1/1979 | Barlew | |
| D251,321 | S | 3/1979 | Barlew | |
| D257,439 | S | 10/1980 | Horii | |
| D276,861 | S | 12/1984 | Keddie | |
| D297,080 | S | 8/1988 | Hemberg | |
| 4,763,580 | A | 8/1988 | Garland | |
| 4,810,031 | A | 3/1989 | Patterson | |
| 4,950,033 | A | 8/1990 | Anderson | |
| 5,176,596 | A | 1/1993 | Ullman | |
| 5,186,703 | A | 2/1993 | Huang | |
| D351,508 | S | 10/1994 | Bonazza | |
| 5,615,619 | A | 4/1997 | King | |
| 5,692,335 | A | 12/1997 | Magnuson | |
| 5,697,870 | A | 12/1997 | Osborn | |
| D407,569 | S | 4/1999 | Underbrink et al. | |
| D415,359 | S | 10/1999 | Boyd | |
| D420,396 | S | 2/2000 | Vieslet | |
| 6,155,641 | A | 12/2000 | Frost | |
| D482,912 | S | 12/2003 | Curotto, Jr. | |
| D485,093 | S | 1/2004 | De Blois | |
| D490,616 | S | 6/2004 | Ljahnicky et al. | |
| D493,618 | S | 8/2004 | DeCarlo et al. | |
| D506,123 | S | 6/2005 | English et al. | |
| 7,097,241 | B2 | 8/2006 | Tally et al. | |
| D558,473 | S | 1/2008 | Mendenhall | |
| 7,488,282 | B2 | 2/2009 | Leavitt | |
| D587,475 | S | 3/2009 | Ren | |
| D610,818 | S | 3/2010 | Crane | |
| 7,814,581 | B1 | 10/2010 | Willner | |
| D627,013 | S | 11/2010 | Nys | |
| 7,922,624 | B1 | 4/2011 | Fairhurst | |
| 7,997,216 | B2 * | 8/2011 | Thornbury | A47B 37/04 108/157.1 |
| D684,215 | S | 6/2013 | Markowitz | |
| D688,050 | S | 8/2013 | Gologorsky | |
| D699,043 | S | 2/2014 | McNae | |
| D701,582 | S | 3/2014 | Sterios | |
| D710,031 | S | 7/2014 | Simpson | |
| D710,622 | S | 8/2014 | Nigro | |
| D733,230 | S | 6/2015 | Mallory | |
| 10,251,488 | B2 | 4/2019 | Lan | |
| 10,905,243 | B2 * | 2/2021 | Lan | A61H 15/00 |
| 2002/0055427 | A1 | 5/2002 | Jennings | |
| 2002/0177509 | A1 | 11/2002 | Rogers et al. | |
| 2003/0199375 | A1 | 10/2003 | Edwards | |
| 2004/0192523 | A1 | 9/2004 | Wu | |
| 2007/0161476 | A1 | 7/2007 | Davies | |
| 2008/0113854 | A1 | 5/2008 | Ferri | |
| 2009/0062093 | A1 | 3/2009 | Clark | |
| 2010/0240509 | A1 | 9/2010 | Chen | |
| 2012/0214653 | A1 | 8/2012 | Tsou | |
| 2012/0329623 | A1 | 12/2012 | Ramirez | |
| 2013/0324382 | A1 | 12/2013 | Wilson | |
| 2015/0231437 | A1 | 8/2015 | Welsh | |

OTHER PUBLICATIONS

International Preliminary Report on Patentability dated Sep. 16, 2021 from PCT International Patent Application No. PCT/US2020/021439.

* cited by examiner

YOGA STOOL

CROSS-REFERENCE TO RELATED APPLICATION

This application is a continuation of U.S. patent application Ser. No. 16/295,754, filed Mar. 7, 2019, now U.S. Pat. No. 10,905,243, entitled YOGA STOOL which is a continuation-in-part of U.S. patent application Ser. No. 14/950,536, filed Nov. 24, 2015 now U.S. Pat. No. 10,251,488, issued Apr. 9, 2019 entitled YOGA STOOL which claims benefit of and priority to Provisional Patent Application No. 62/084,121, filed Nov. 25, 2014, the entire content of each of which is incorporated by reference herein.

BACKGROUND

Field of the Disclosure

The invention relates to a stool, particularly for use in practicing yoga, having a combination of features adapted for facilitating a wide variety of yoga postures as well as for other stretching or physical fitness activities.

Related Art

It is known to practice yoga while seated in a chair, or to incorporate a chair or another structure such as a wall into the yoga practice. However, chairs are not standardized and walls are not always accessible in a given space. The use of chair for other fitness or wellness activities is also known such as for stretching, physical therapy and other exercise. Conventional chairs, however may limit the types of exercise that may be performed as they may limit the user's range of motion.

It would be desirable to provide a portable, compact, multi-function support unit to perform the functions of both chairs and walls in order to make the practice of yoga, and other fitness or wellness activities more comfortable and convenient.

It would further be desirable for the support unit to provide specific handholds and footholds to guide and facilitate the yoga practice and other fitness activities.

SUMMARY

In embodiments a yoga stool may include a seat portion and a base portion; the base portion having opposed top and bottom sides, opposed left and right sides, and opposed front and rear sides; a window slot formed in at least one of the front side and the rear side; a horizontal gripping slot formed in an upper portion of at least one of the left side and the right side; a vertical gripping slot formed in a lower portion of at least one of the left side and the right side. The yoga stool preferably may have at least two vertical gripping slots formed respectively in the lower portions of the left side and the right side, and even more preferably four vertical gripping slots formed in the lower portions of the left side and the right side, two of said slots being near or at the front side and two of the slots being near or at the back side, and/or two horizontal gripping slots formed respectively in the left side and the right side.

In embodiments, a yoga stool may comprise a base portion, and a seat portion on top of the base portion; the base portion having opposed top and bottom sides, opposed left and right sides, and opposed front and rear sides; wherein the seat portion has an internal horizontal firm support member such as a solid slat, and soft material such as foam rubber surrounding the support member adjacent the left, right, front and rear sides.

In embodiments, a yoga stool may include opposed left and right elements connected to opposed front and rear elements; wherein at least one of the left and right elements includes at least one horizontal opening and at least one vertical opening; a removable top element connected to the opposed left and right elements and at least one of the opposed front element and rear element.

Other features and advantages of the invention will be appreciated from the following description of embodiments thereof, with reference to the drawings.

DETAILED DESCRIPTION

Figure 1:
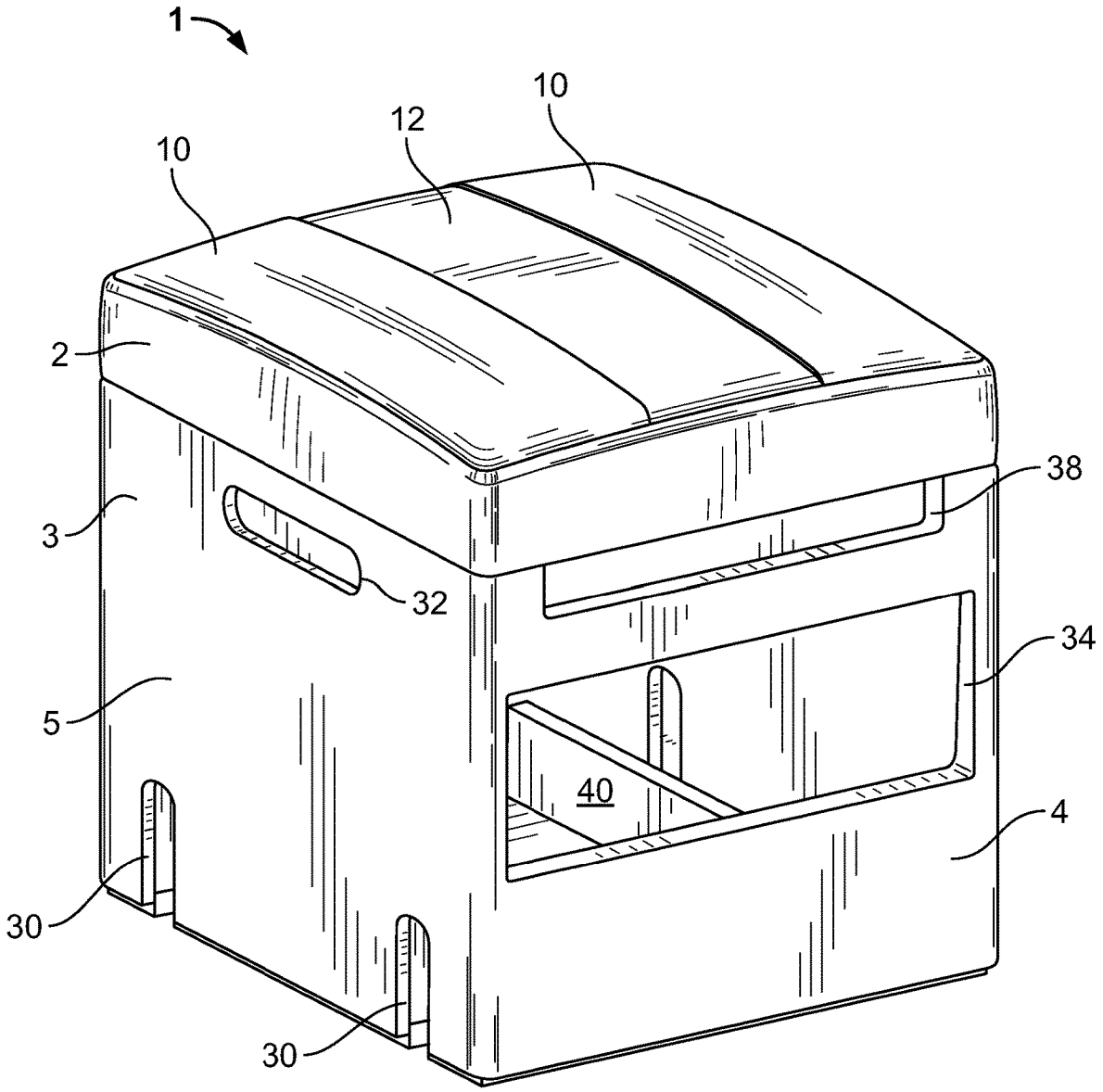
FIG. 1 is a front right perspective view of a yoga stool according to an embodiment of the invention.
Figure 2:
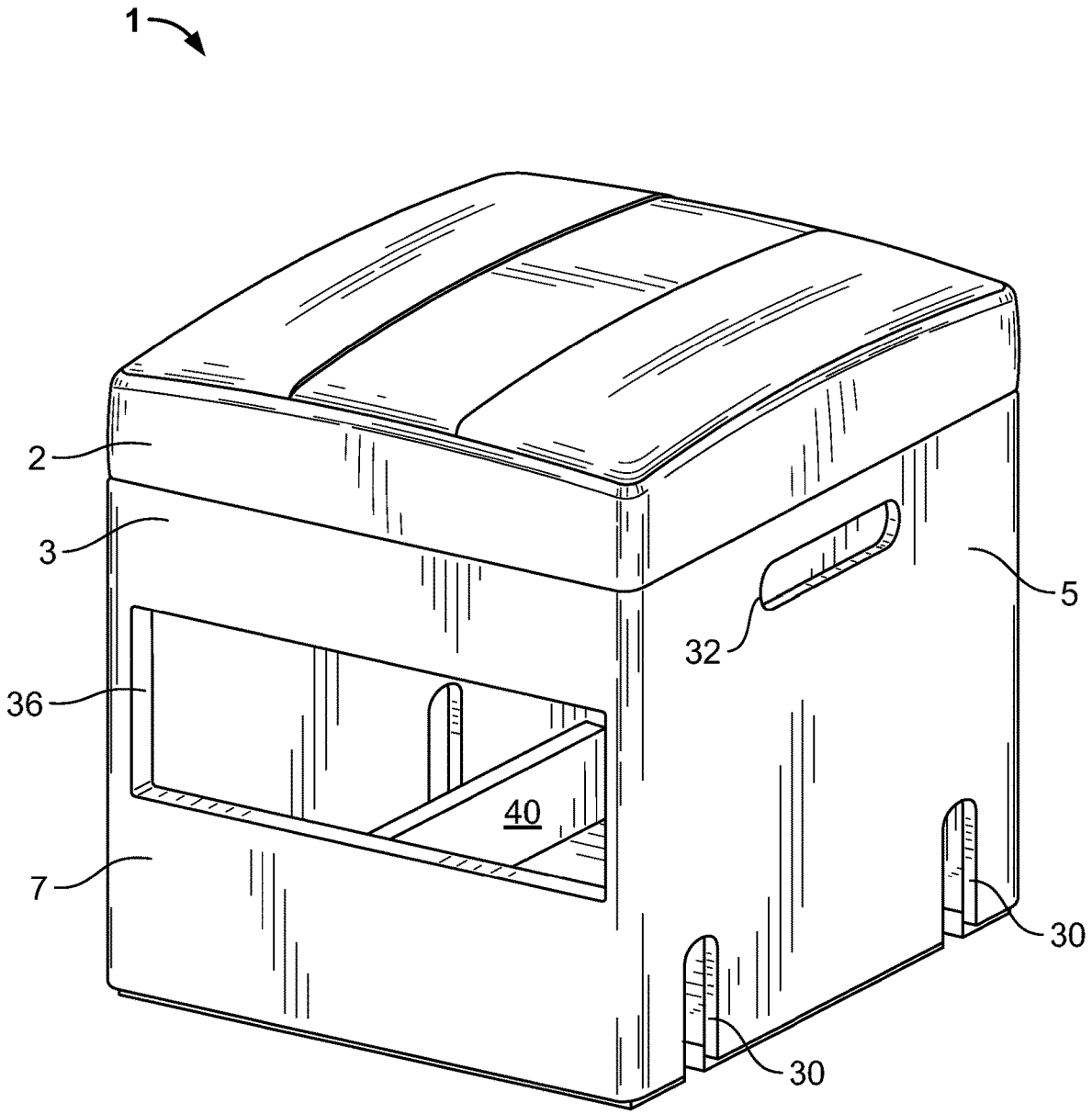
FIG. 2 is a rear right perspective view thereof.
Figure 3:
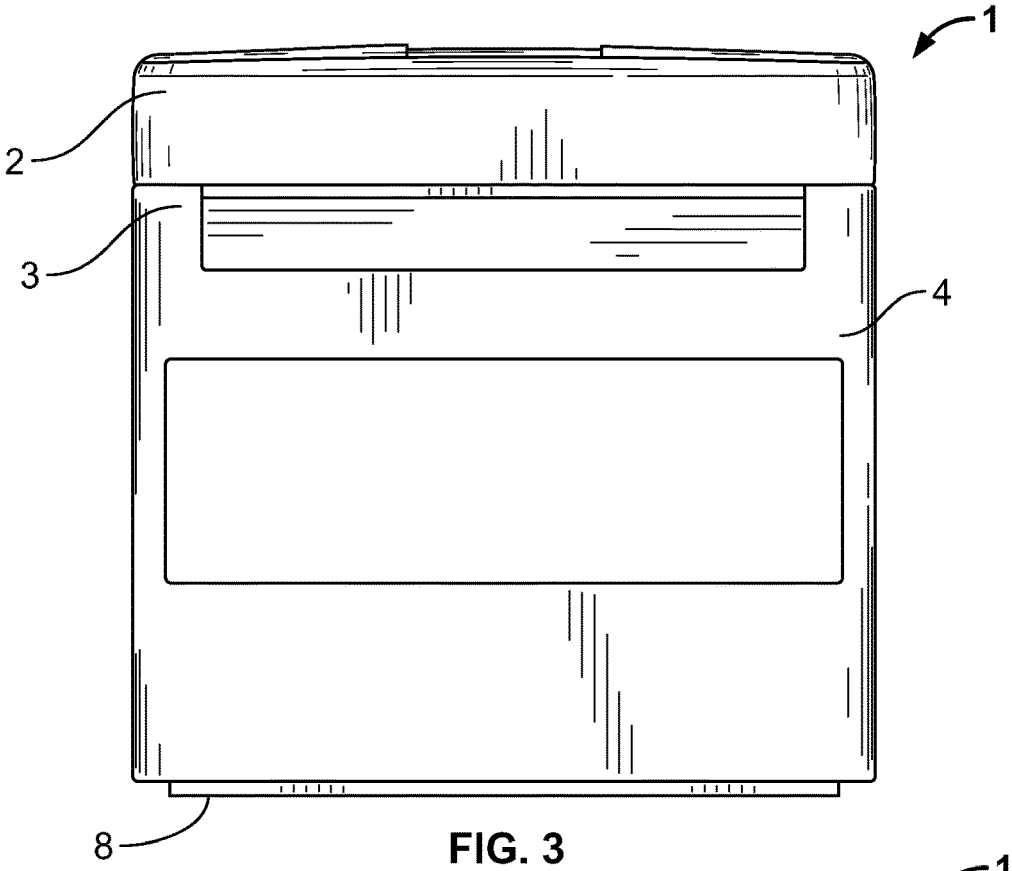
FIG. 3 is a front elevation view thereof.
Figure 4:
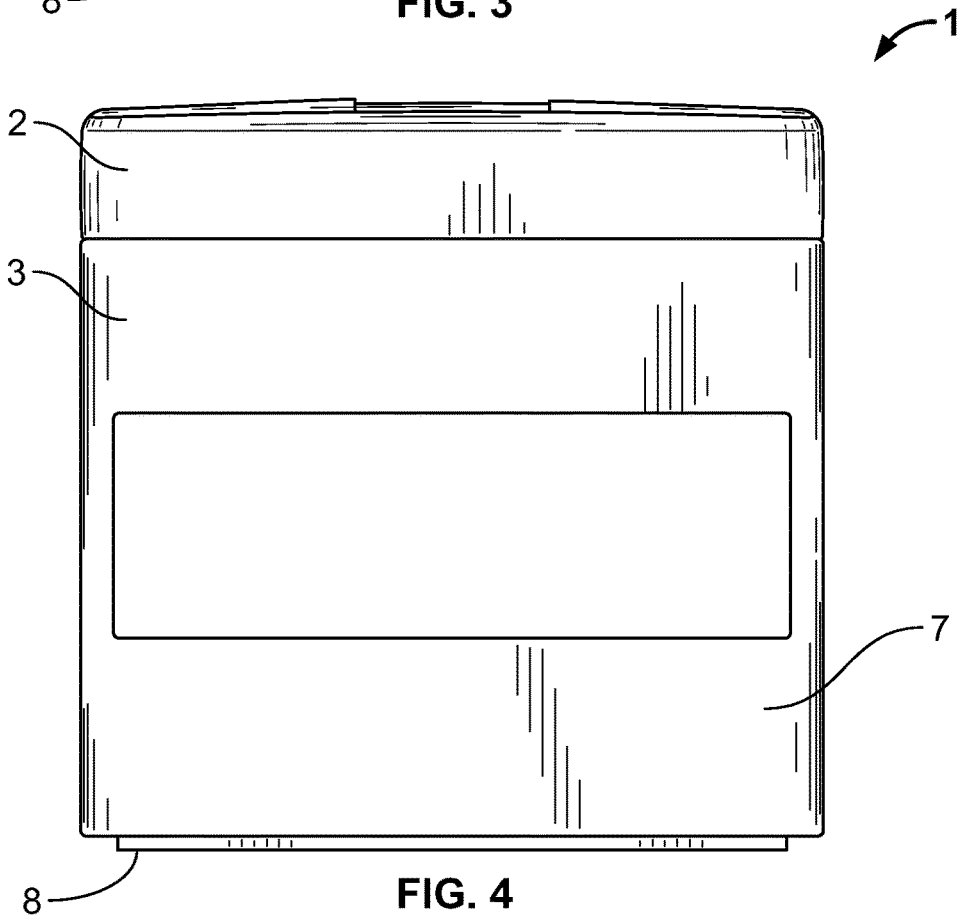
FIG. 4 is a rear elevation view thereof.

FIGS. 1-8 show a yoga stool according to an embodiment of the invention, comprising the following major parts: yoga stool 1, seat portion (seat) 2, base portion (base) 3, front side of base 4, right side of base 5, left side of base 6, rear side of base 7, and bottom of base 8. While the term "yoga stool" is used herein, the stool 1, 101 of the present disclosure is suitable for use in addition applications such as stretching, physical therapy and other exercise or wellness activities, to name a few.

As seen in the figures, the yoga stool 1 is generally cubical in shape.

Referring to FIG. 1, the seat 2 may be covered for example by a pair of spaced-apart side strips 10 made for example of a rubber material for being securely gripped, and a middle strip 12 which may be made of cotton for a decorative effect. Other suitable materials may be used. In embodiments, a single strip of rubber material may be used. In embodiments more than two strips of rubber material may be used. In embodiments, the strips 10 may not be rubber. In embodiments, the strips 10 may be made of a material that provides for better gripping and reduced slipping.

In embodiments, the seat 2 has high density foam rubber or another suitable material beneath the cover strips 10,12. In embodiments, the seat 2 may include another material beneath the cover strips that provides resilience and cushioning.

Figure 5:
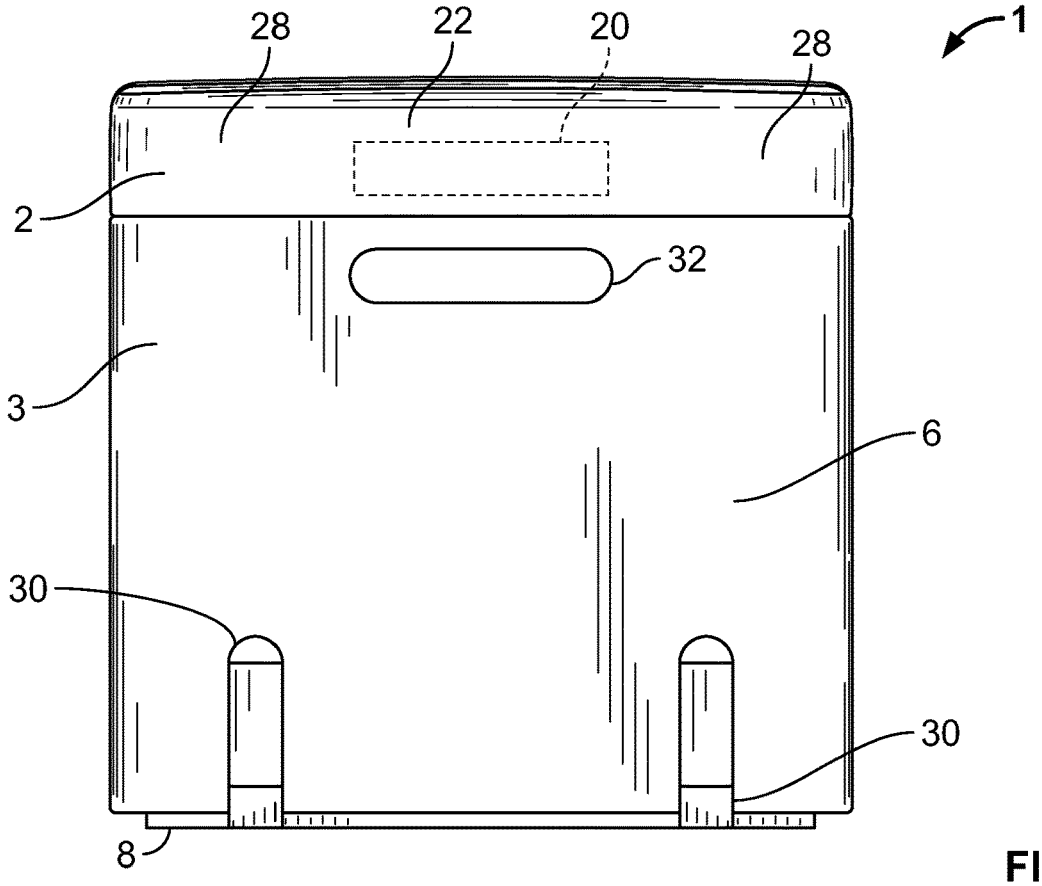
FIG. 5 is a left side elevation view thereof.
Figure 6:
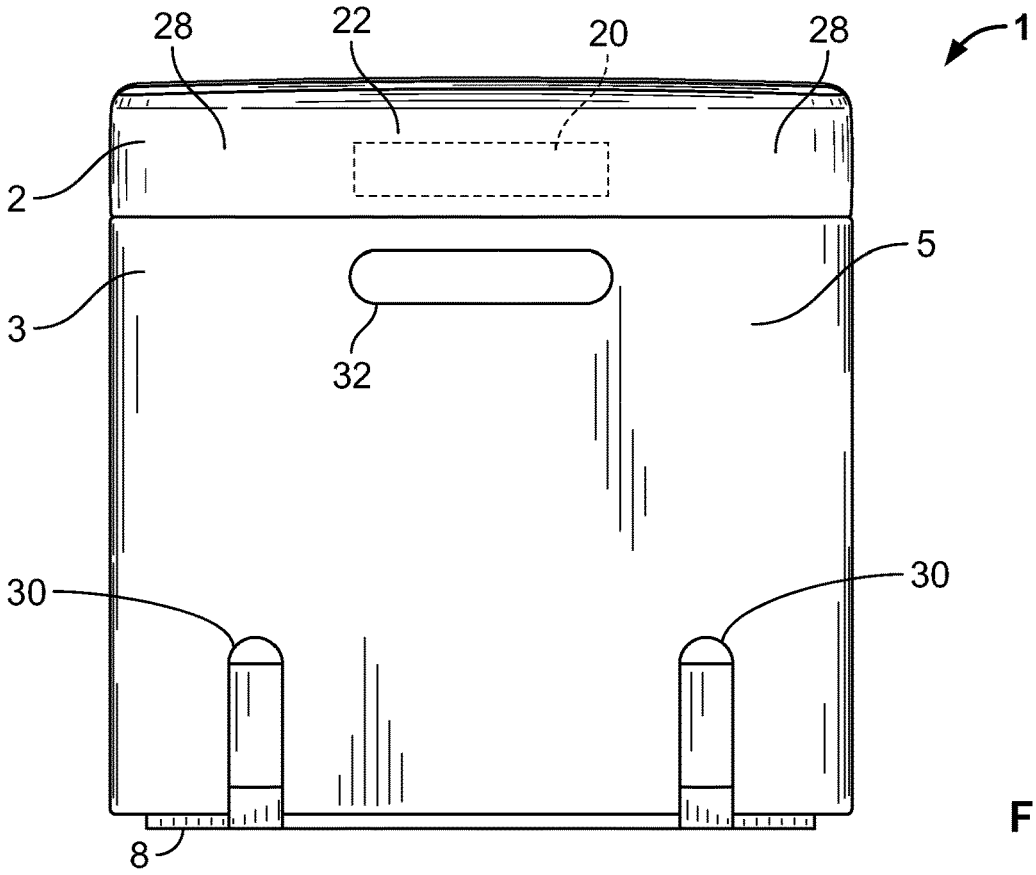
FIG. 6 is a right side elevation view thereof.
Figure 7:
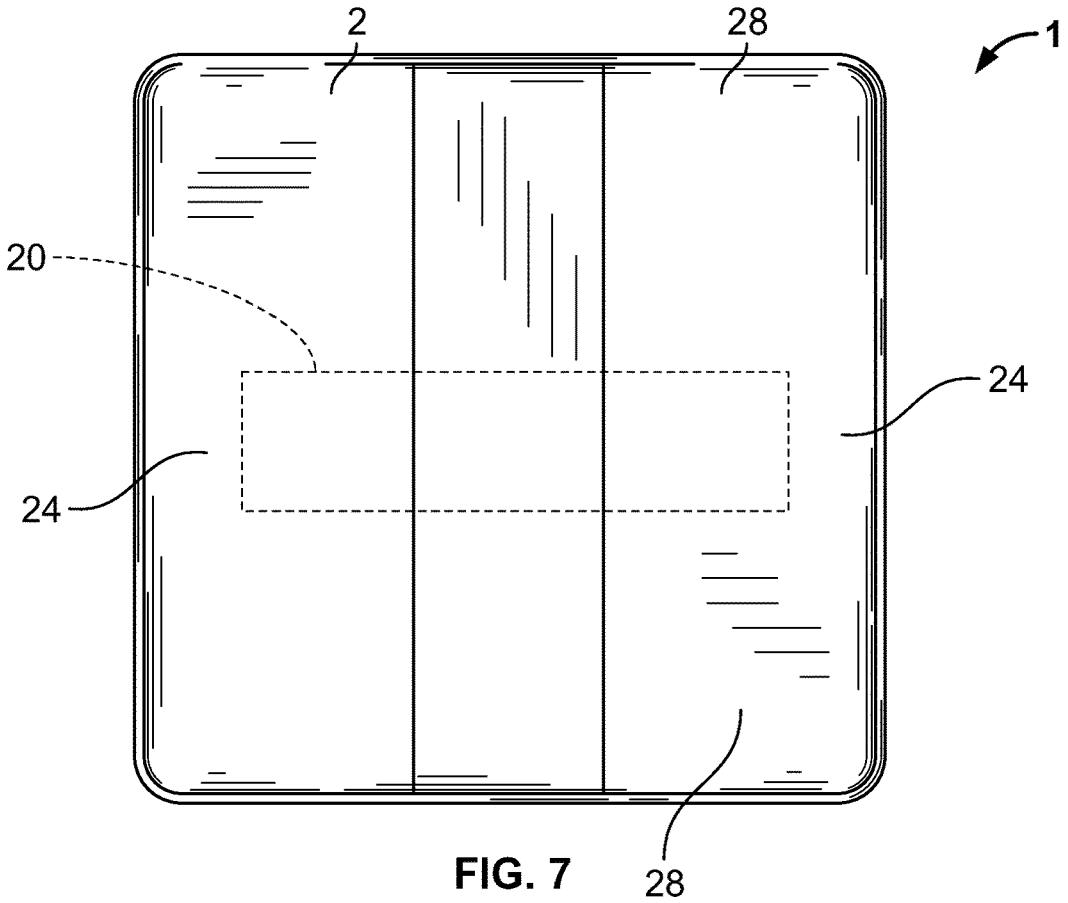
FIG. 7 is a top plan view thereof.
Figure 8:
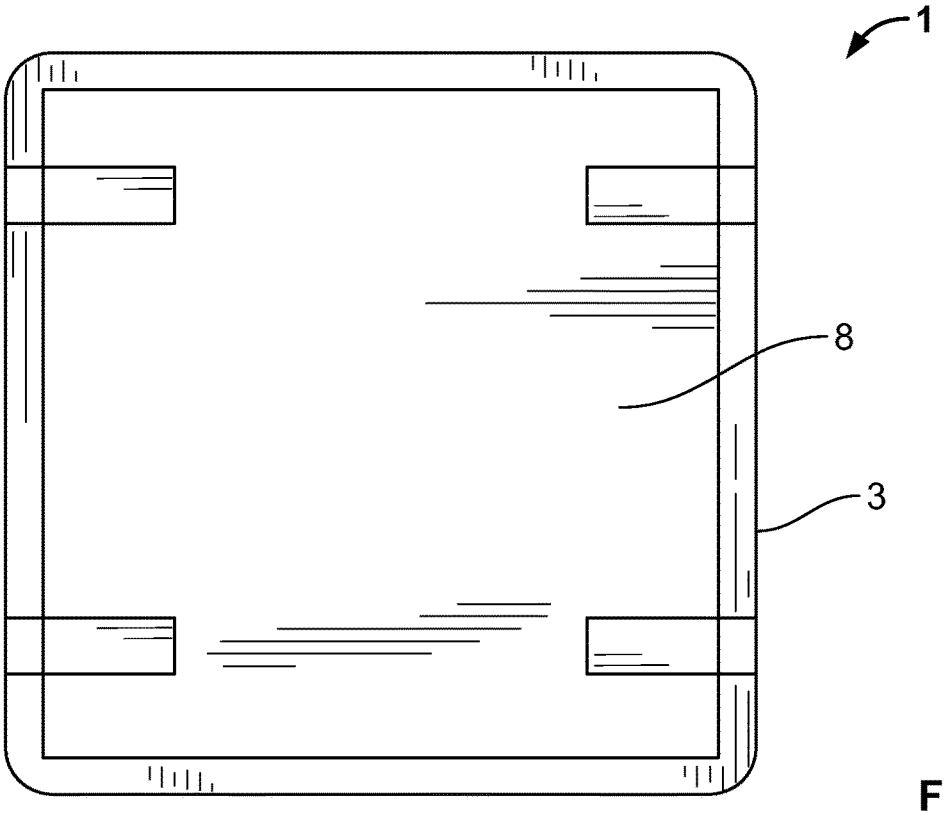
FIG. 8 is a bottom plan view thereof.

As shown in dashed lines in FIGS. 5, 6, and 7, a slat 20 which may be made of wood or another stiff material is arranged in the seat 2 for providing a firm seating surface, as well as firm support for the user's wrist, and/or the heel of the hand. In embodiments, the slat 20 is covered by a top layer 22 of foam rubber or the like. In embodiments, the slat 20 extends part way across the seat 2, between the right and left sides 5,6, leaving side portions 24 and front and rear portions 28 that are filled with foam rubber and provide a comfortable resting and gripping area for the hands.

Optionally, the slat may be omitted from the middle of the seat 2, but instead two or more smaller slats or other suitable supports may be provided within the seat.

The base 3 has four vertical side gripping slots 30 formed in lower portions of the right side 5 and the left side 6, near or at the bottom side 8, to be gripped by the user for performing various yoga postures. In this context, "lower portion" or "near or at the bottom" refers to a suitable location for performing yoga postures in conjunction with the floor.

The upper portions of the right and left sides 5,6 each have a horizontal gripping slot 32 near the top for performing other yoga postures. In this context, "upper portion" or "near or at the top" refers to a suitable location for being gripped by a user seated on the seat.

The front side 4 and the rear side 7 have respective generally rectangular window slots 34, 36 extending substantially from side to side of the stool and occupying approximately the middle third of the surface area of the respective side 4 or 7.

Optionally, rollers for foot massage may be mounted at one or both window slots 34,36 at a position accessible from outside the base portion for massaging the feet.

The upper portion of the front side 4 also has a handle slot 38 near or at the top of the base portion 3. In this context, "upper portion" or "near or at the top" refers to an appropriate location for carrying the yoga stool. In embodiments, any of the opening discussed herein may be used as a handle.

In embodiments, interior braces 40 near or at the bottom 8, may be provided for increasing the structural integrity of the stool. In embodiments, the braces 40 may be used in conjunction with a storage box (not shown) for storing the stool. The interior of the stool may also be used for storage of other equipment, such as yoga blocks for example. Securing means such as a cover, strap, or zipper for enclosing the stored items may be provided. Anchors such as U-bolts mounted on the braces 40, for example, may also be provided for ropes, bungees, etc. for facilitating other postures and exercises.

In embodiments, the bottom 8 may be surfaced with rubber or another material suitable for providing secure gripping with the floor.

In embodiments, all the slots and windows described above are preferably lined with foam rubber or another soft material for providing a comfortable grip or other contact point for the user.

Figure 9:
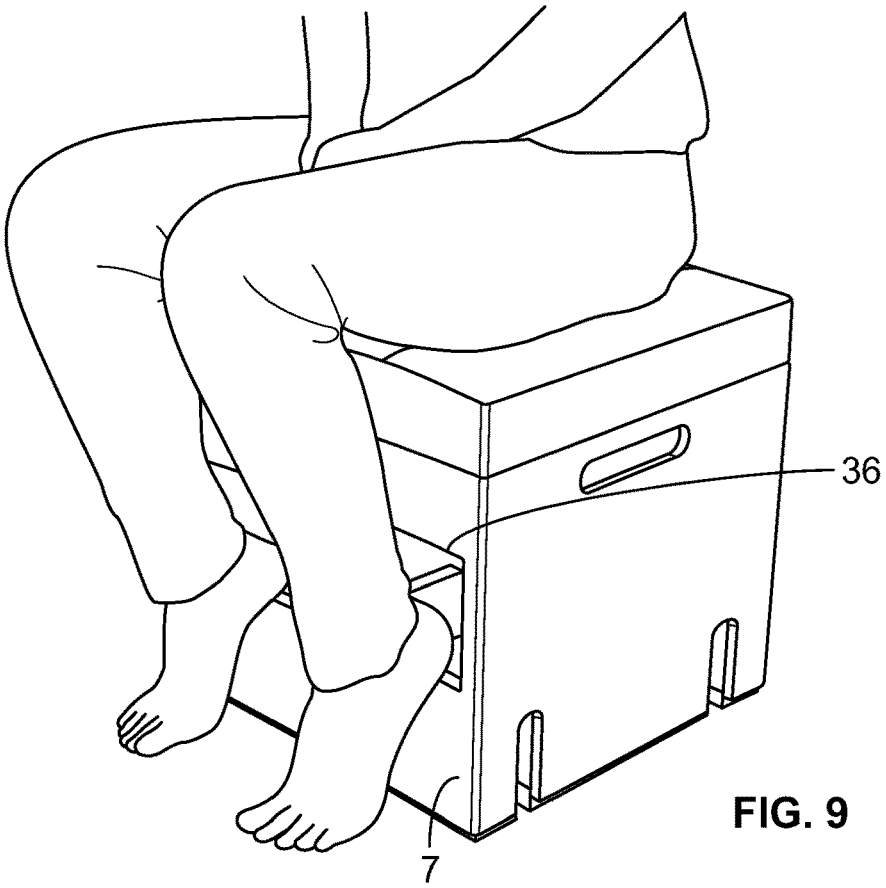
FIG. 9-12 show a user seated on the stool and interacting with the stool in a respective plurality of positions.

Referring now to FIG. 9, a user is shown with heels hooked on the window slot 36 on the rear side 7 for stretching the feet.

Figure 10:
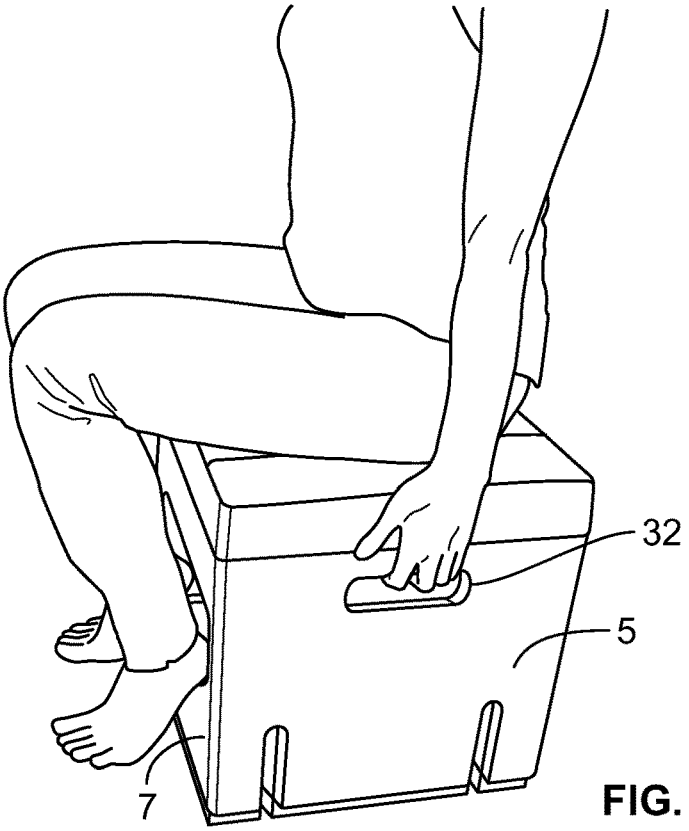

In FIG. 10, the user further has the hands gripped in the side slots 32 for stretching the spine.

Figure 11:
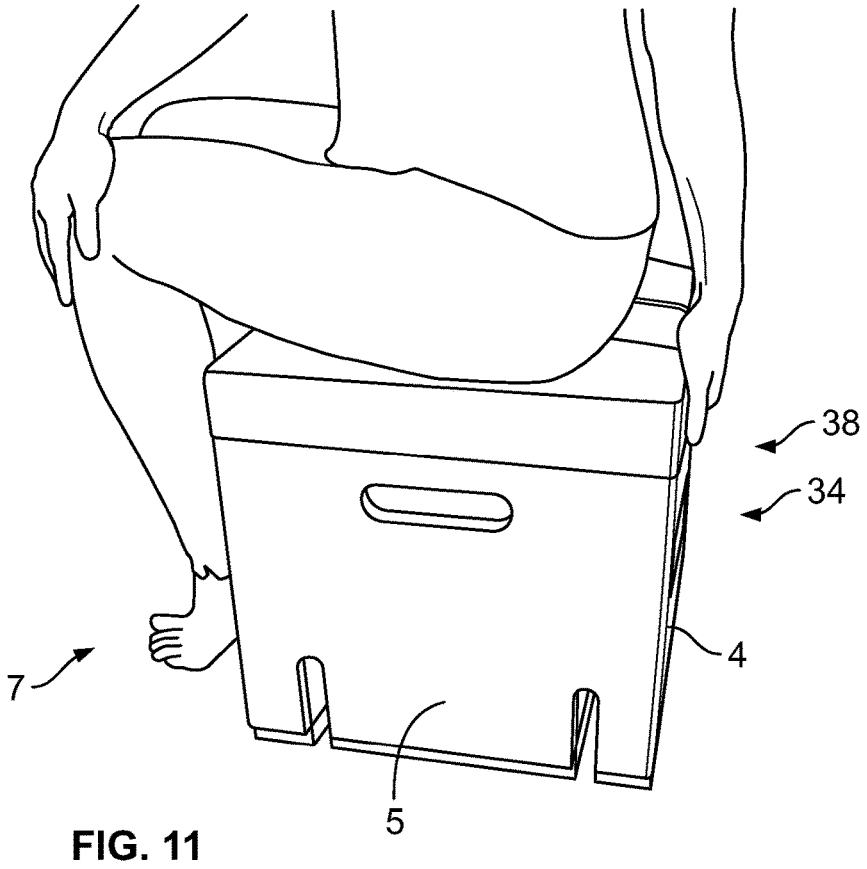

In FIG. 11, the user is performing a spinal twist with the heels on the window slot 36, the right hand on the left knee, and the left hand gripped in the top handle slot 38 on the front side 4.

Figure 12:
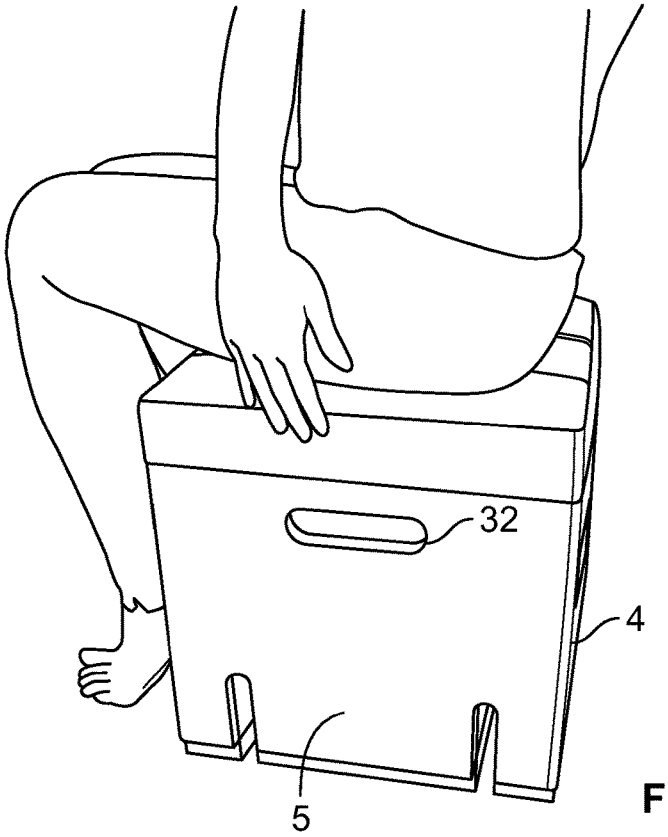

In FIG. 12, the user is performing a further spinal twist with the heels on the window slot 36, the right hand on the right side 5 of the stool, and the left hand gripped in the handle slot 32 on the left side 6 of the stool.

Figure 13:
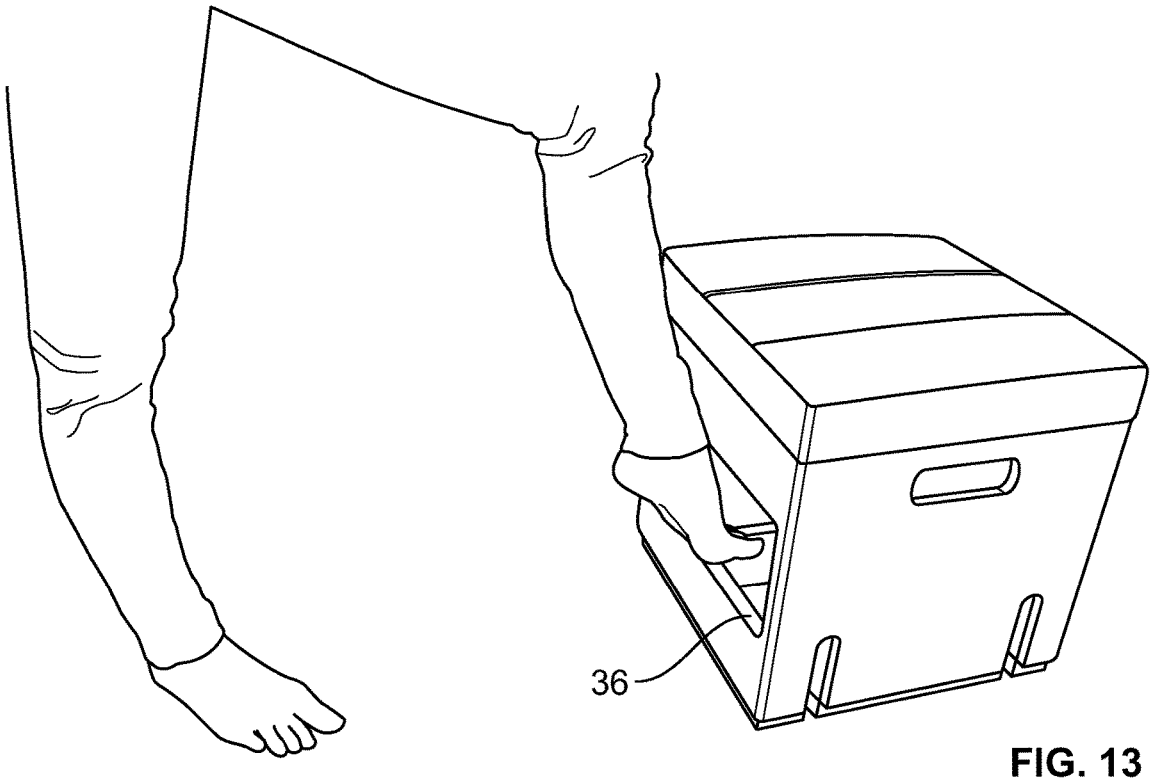
FIGS. 13-17 and 19 show a user standing near the stool and interacting with the stool in a respective plurality of positions.

FIG. 13 shows the user with the left toes hooked on the rear window slot 36 for stretching the left leg.

Figure 14:
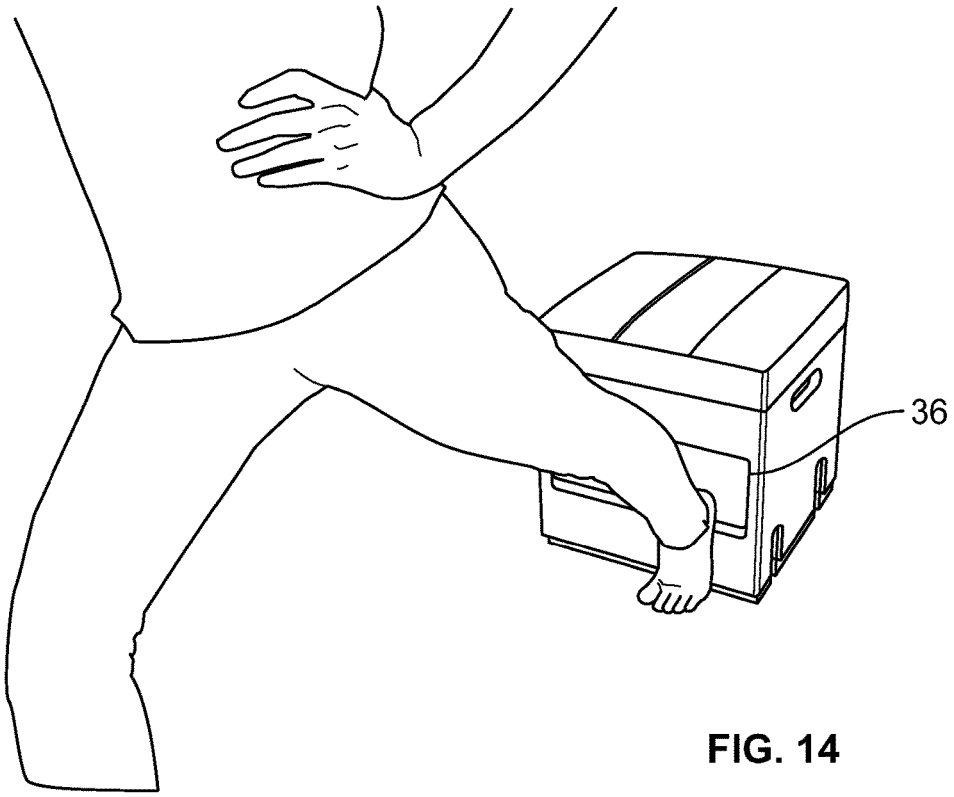

FIG. 14 shows the user with the left heel hooked on the rear window slot 36 for performing another leg stretch.

Figure 15:
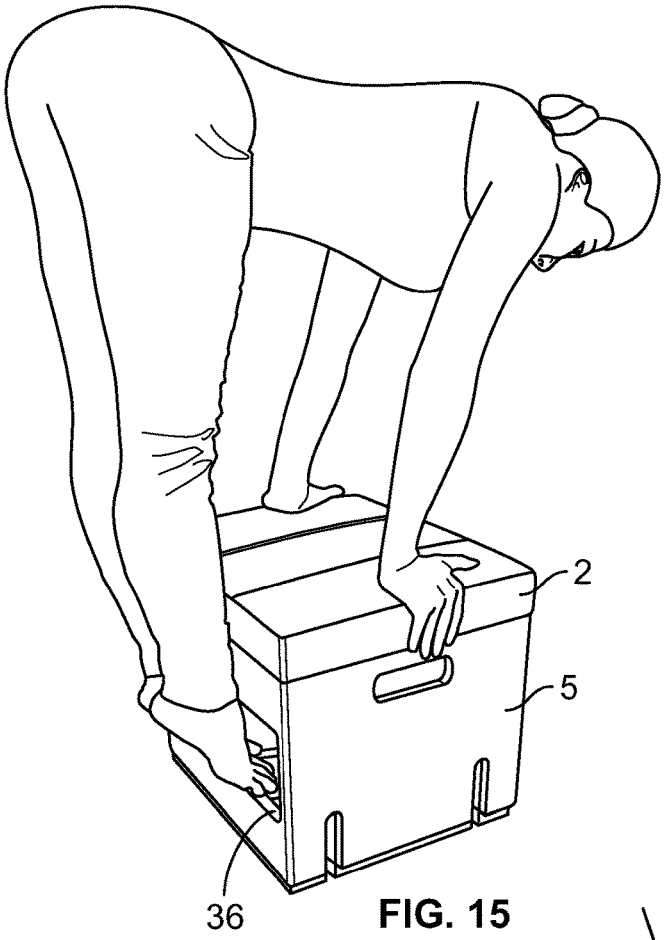
Figure 16:
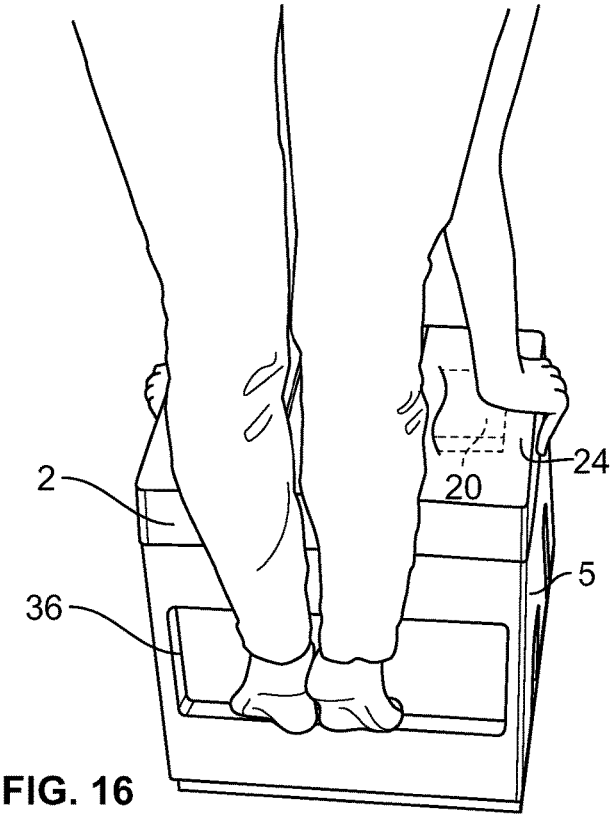

FIGS. 15 and 16 are two views showing the user with the toes of both feet hooked on the rear window slot 36 and the right and left hands disposed respectively on the right and left sides of the seat 2. The wrist and the heels of the hands are supported respectively on the right and left ends of the slat 20 inside the seat 2. The remainder of the hands extends over the side portions 24 of the seat 2 where the slat 20 is not present.

Figure 17:
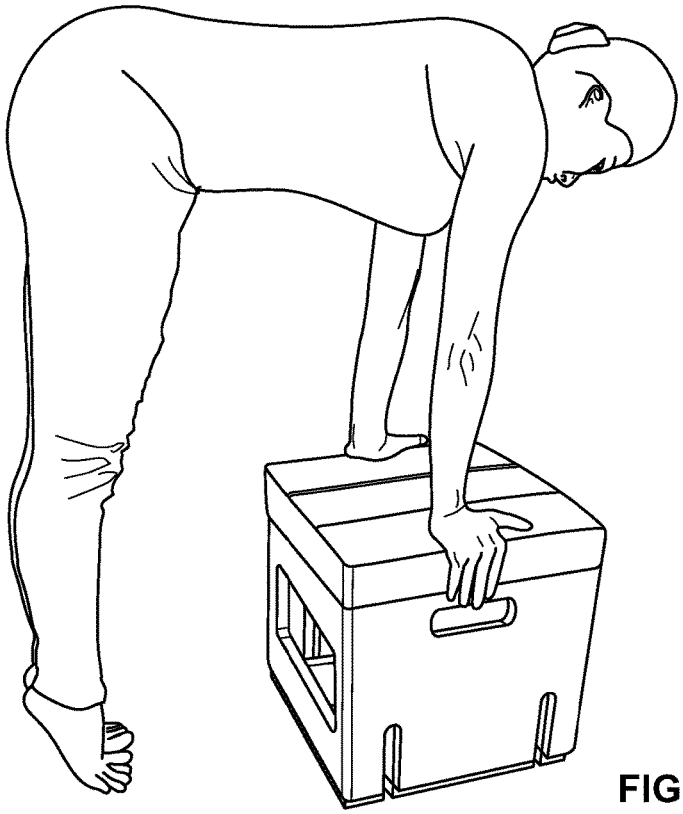

FIG. 17 is similar to FIGS. 15 and 16, but the feet have been moved away from the stool for performing a different stretch.

Figure 18:
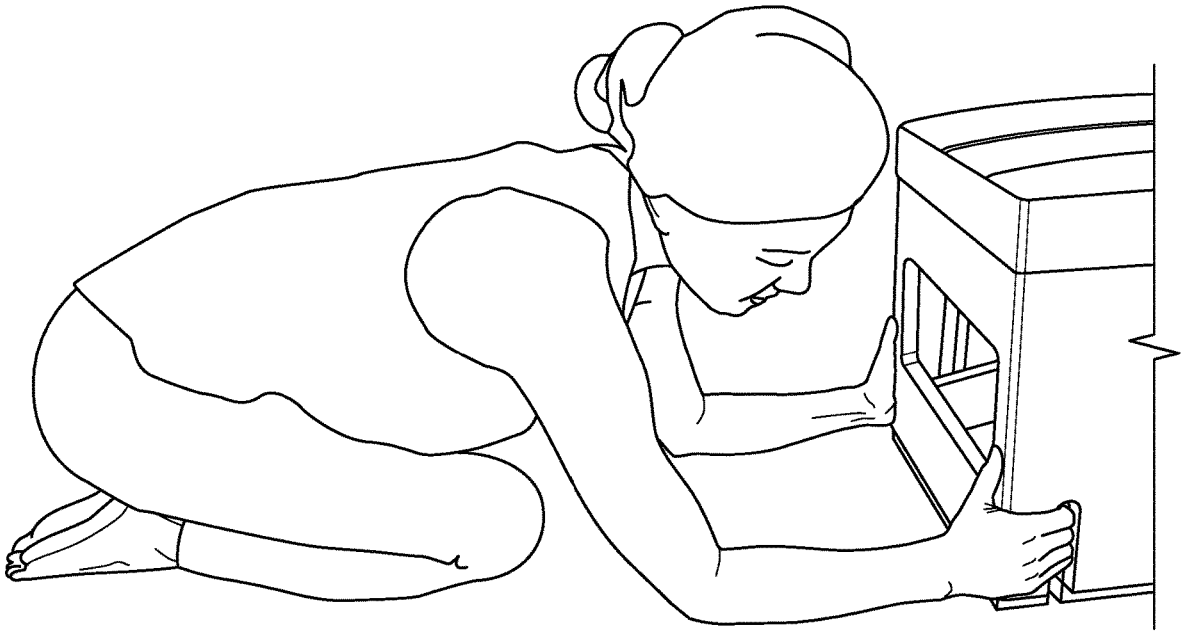
FIG. 18 shows a user kneeling near the stool and interacting with the stool.
Figure 19:
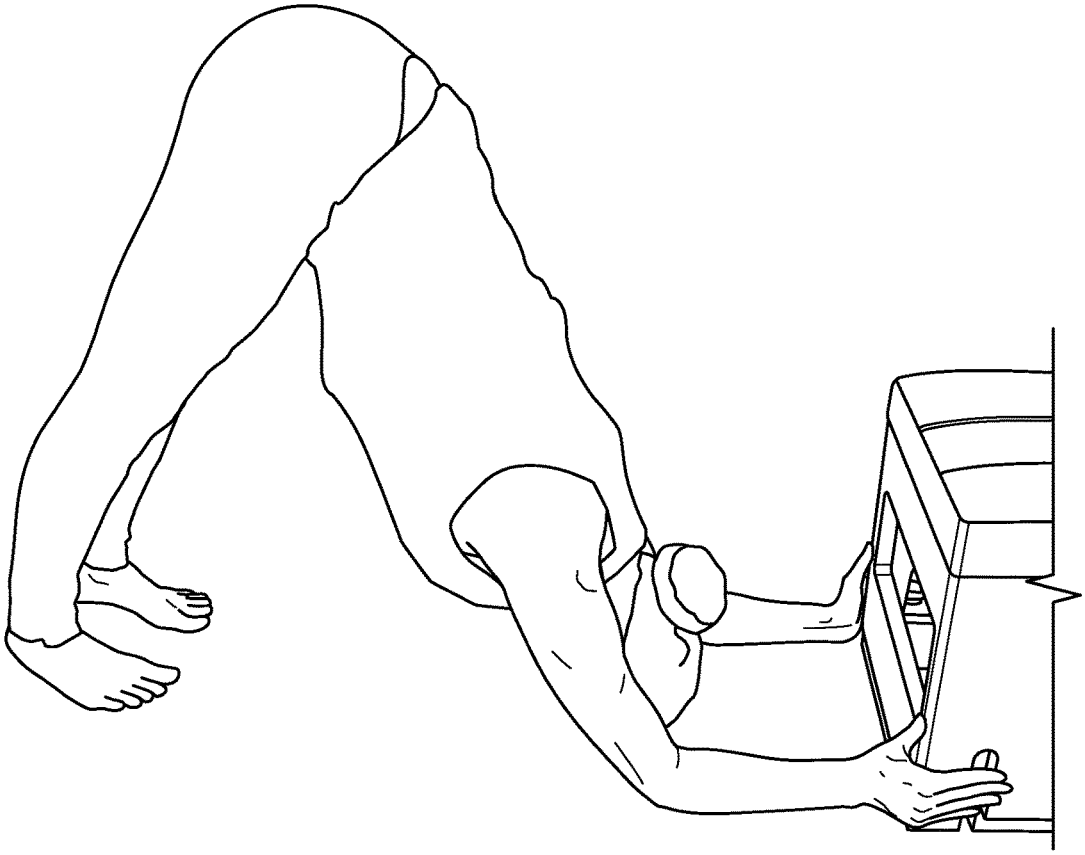

FIGS. 18 and 19 show the user gripping the vertical slots 30 at the bottom of the rear side 7 of the stool. In FIG. 18 the user is performing a kneeling posture, while in FIG. 19 the user is performing a forward bend.

Figure 20:
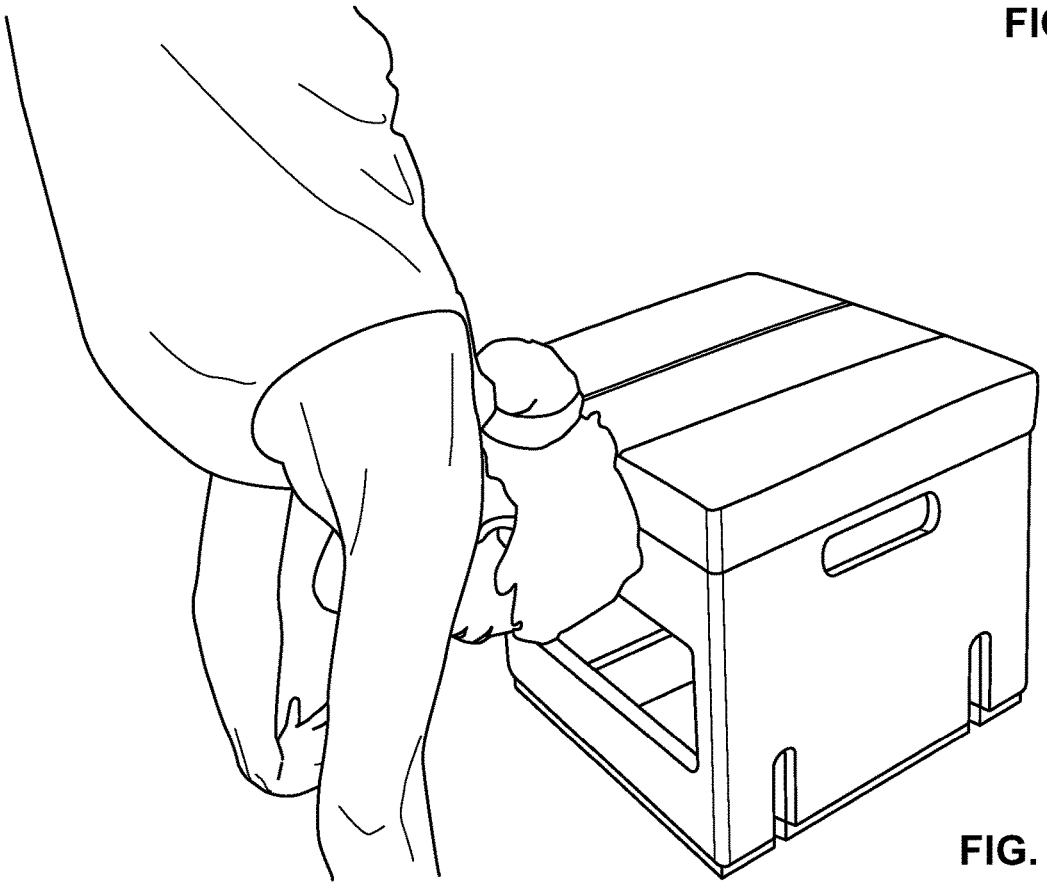
FIG. 20 shows a user performing a handstand near the stool and interacting with the stool.

FIG. 20 shows the user performing a headstand with the head braced against the rear side 7. A forearm stand may also be performed, with the hands gripping the handle slots 30 as in FIG. 18. In either of these stands, the yoga stool is advantageous because the legs can swing farther over the user's head than if the stand were performed against a wall, as is conventional. An indentation for the head may be provided on the rear side 7, the first side 4, and/or elsewhere.

Thus, the combination of elements and parts in the stool 1 provides great versatility in adapting to a wide variety of yoga positions. As noted above, while the stool 1 is referred to as a "yoga stool" it is suitable for use in a variety of applications including stretching, physical therapy and other fitness or wellness activities, to name a few.

Figure 21:
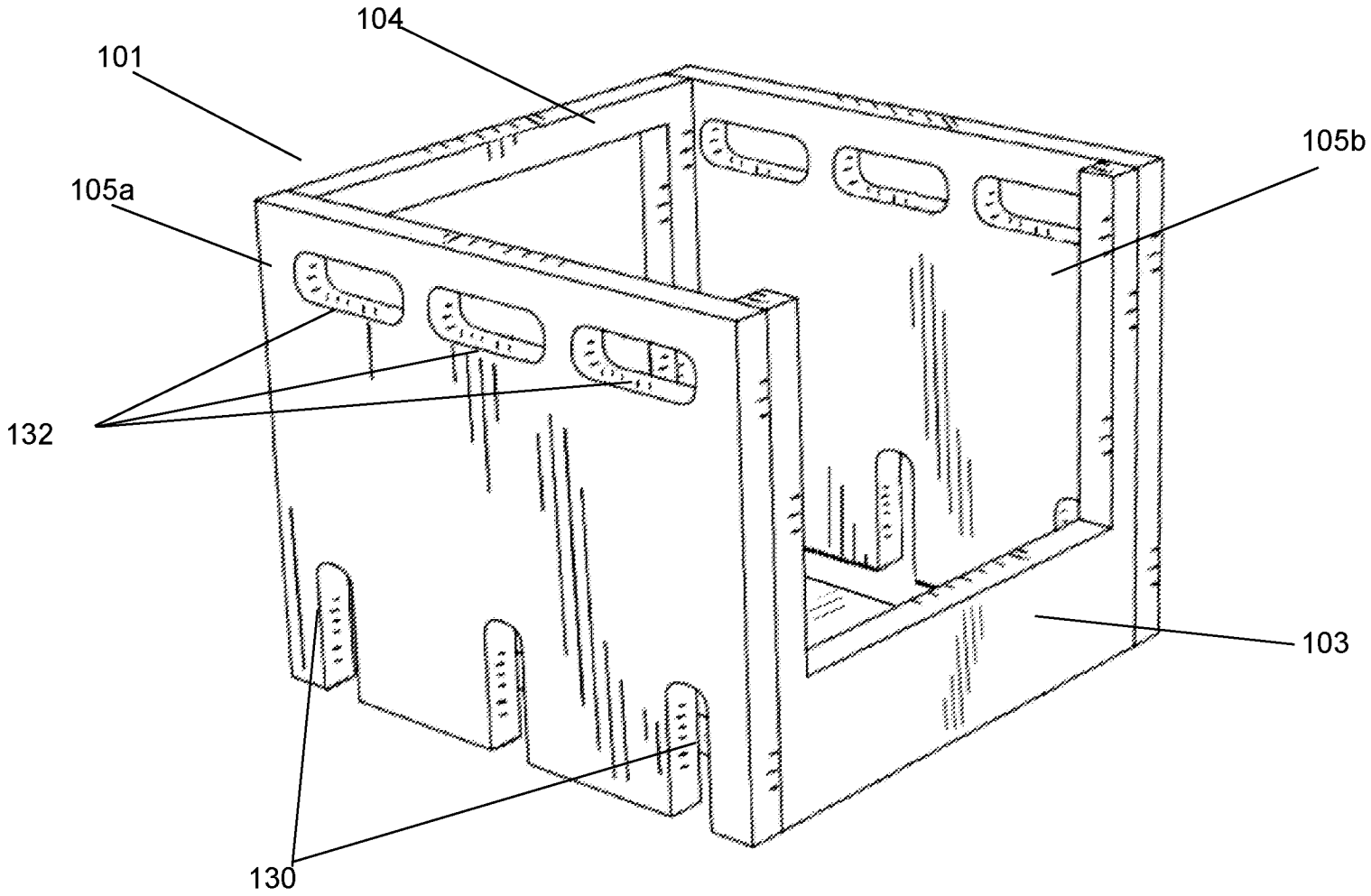
FIG. 21 shows a front perspective view of another embodiment of a yoga stool in accordance with the present disclosure.
Figure 26:
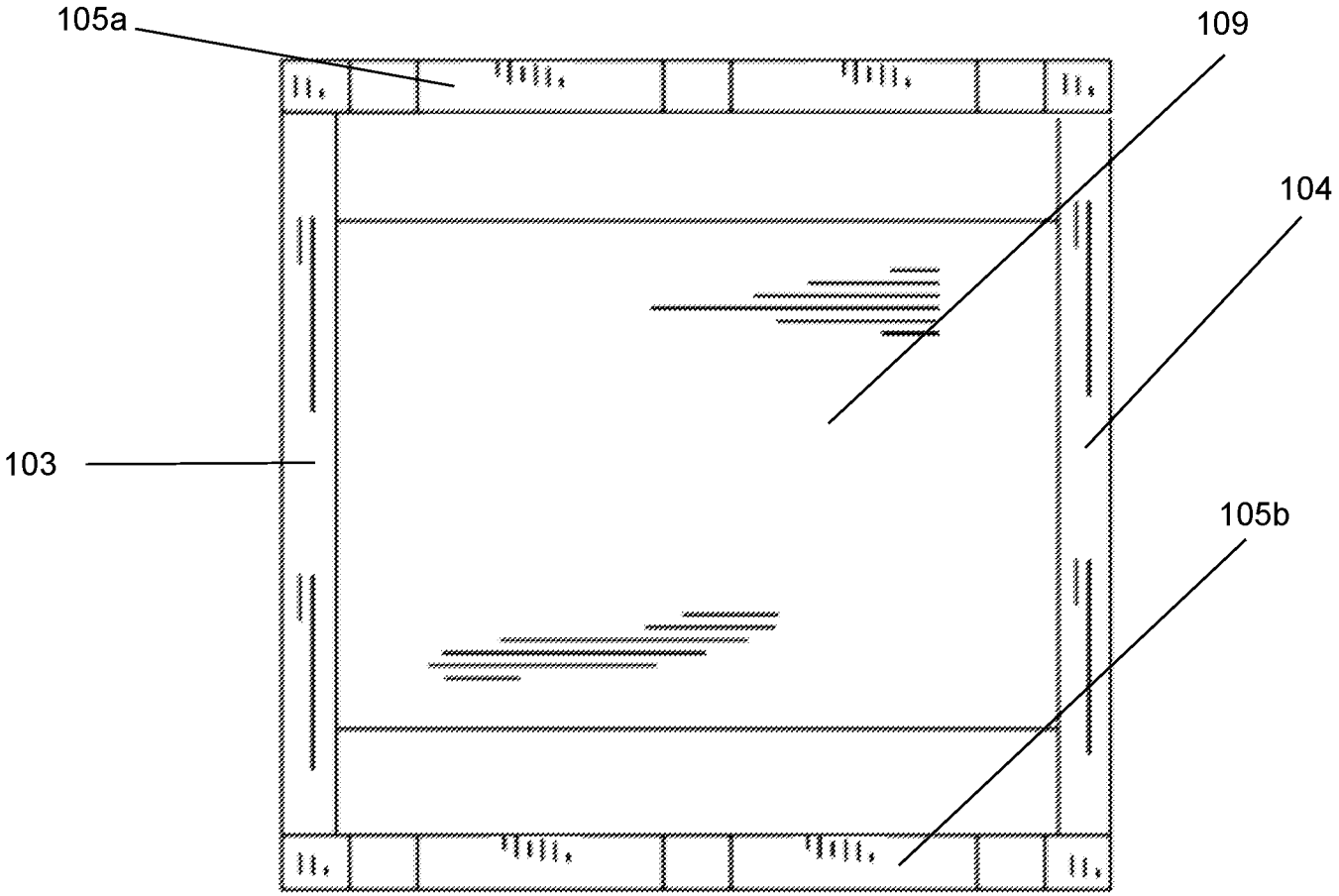
FIG. 26 shows a bottom view of the yoga stool of FIG. 21.

FIG. 21 illustrates an alternative embodiment of a yoga stool 101 including two opposed side elements 105*a*, 105*b*, a front element 103 extending between and connected to the opposed side elements and a rear element 104 also extending between and connected to the opposed side elements. In embodiments, a bottom element 109 may extend between and be connected to the front element 103 and rear element 104 as can be seen in FIG. 26. The width of the bottom element is smaller than the distance between opposed walls

105*a* and 105*b* such that there is space in the interior of the stool 101 for a user's fingers when they are extended through the vertical slots 130.

Figure 23:
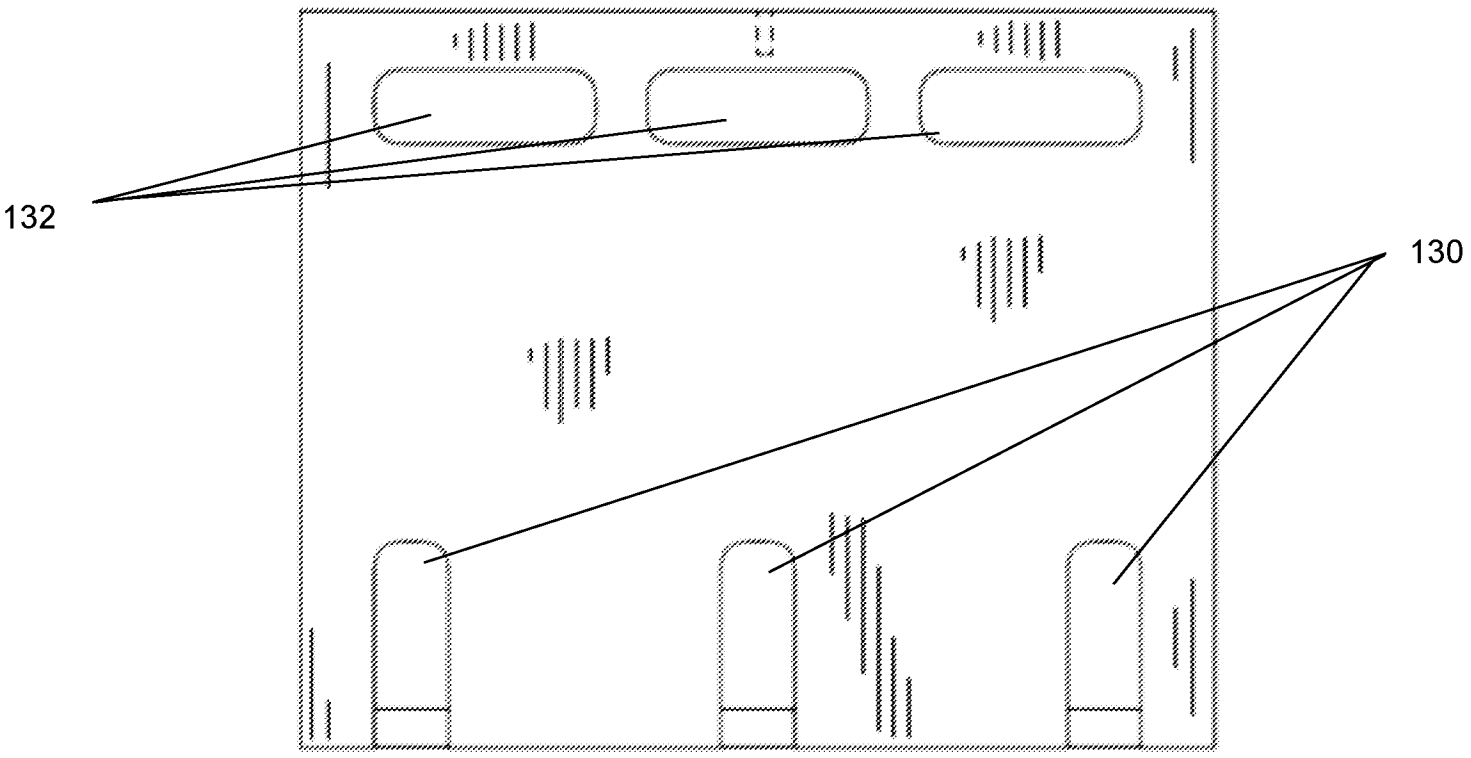
FIG. 23 shows a side view of the yoga stool of FIG. 21.

In embodiments, both side elements 105*a*, 105*b* include three vertical slots 130 positioned along a bottom edge thereof. In embodiments, the side elements 105*a*, 105*b* include three horizontal slots 132 positioned near a top edge thereof (see FIG. 23, for example). The slots 130 and 132 may be used as hand hold. In embodiment, the vertical slots 130 and the horizontal slots 132 may be used as hand holds, foot holds or for any other purpose. In embodiments, the edges of these slots may be padded for comfort.

Figure 22:
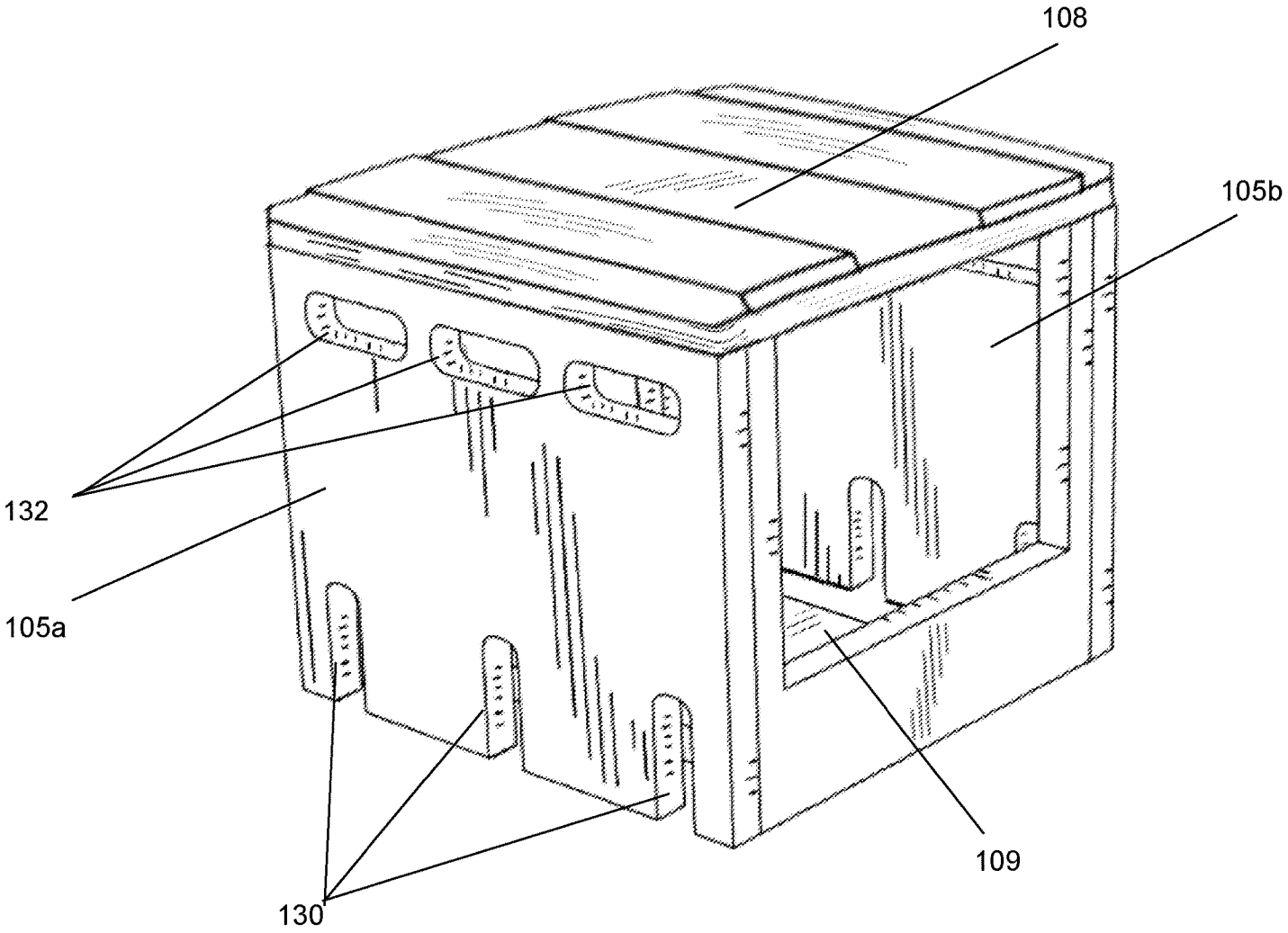
FIG. 22 shows the front perspective view of the yoga stool of FIG. 21 including a full top.

In embodiments, such as illustrated in FIG. 22, for example, a top element 108 may be provided. In embodiments, the top element 108 may be substantially flat and extend between the opposed sided 105*a*, 105*b* as well as between the front element 103 and the rear element 104. In embodiments, the top element 108 may be padded or partially padded. In embodiments, the top element 108 may include one or more strips of material to aid grip. In embodiments, additional support structures may be added to the top element 108.

Figure 24:
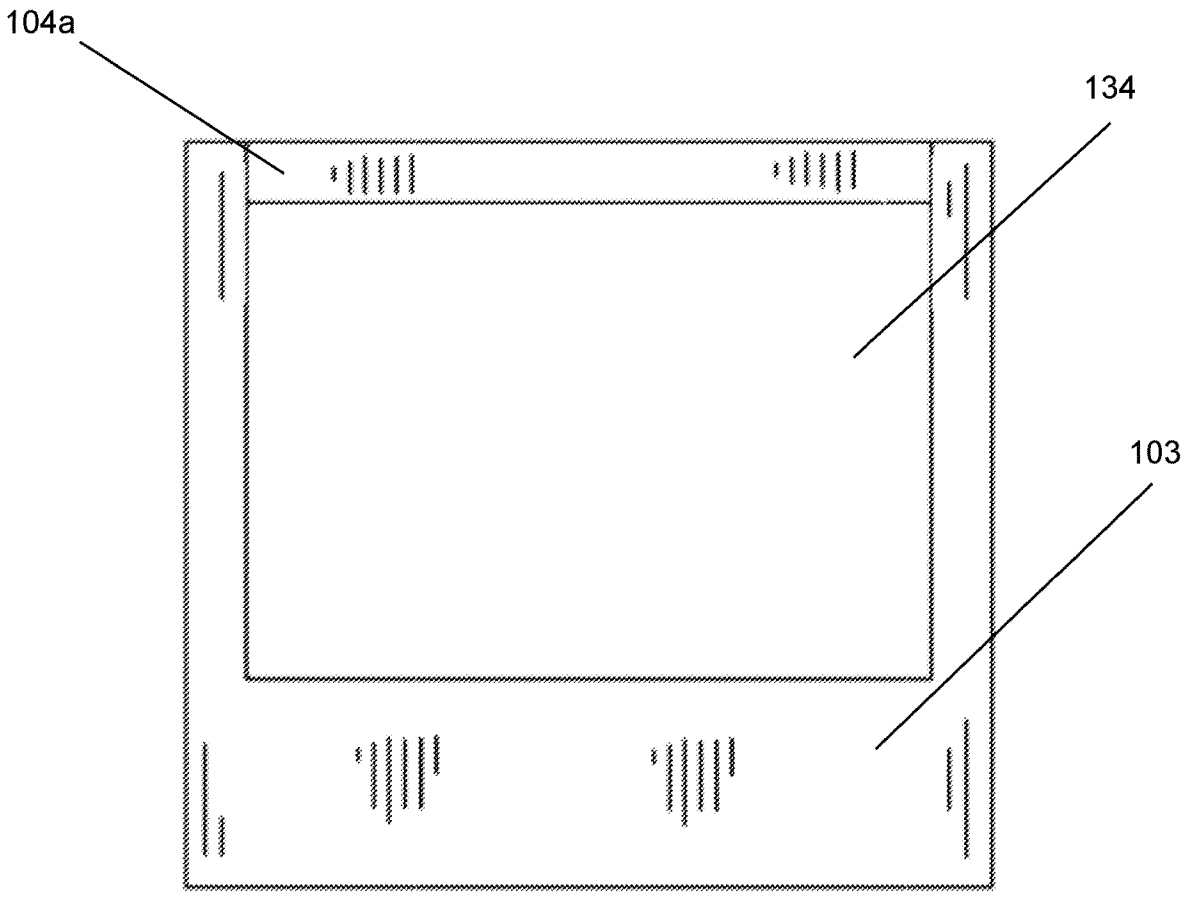
FIG. 24 shows a front view of the yoga stool of FIG. 21.
Figure 25:
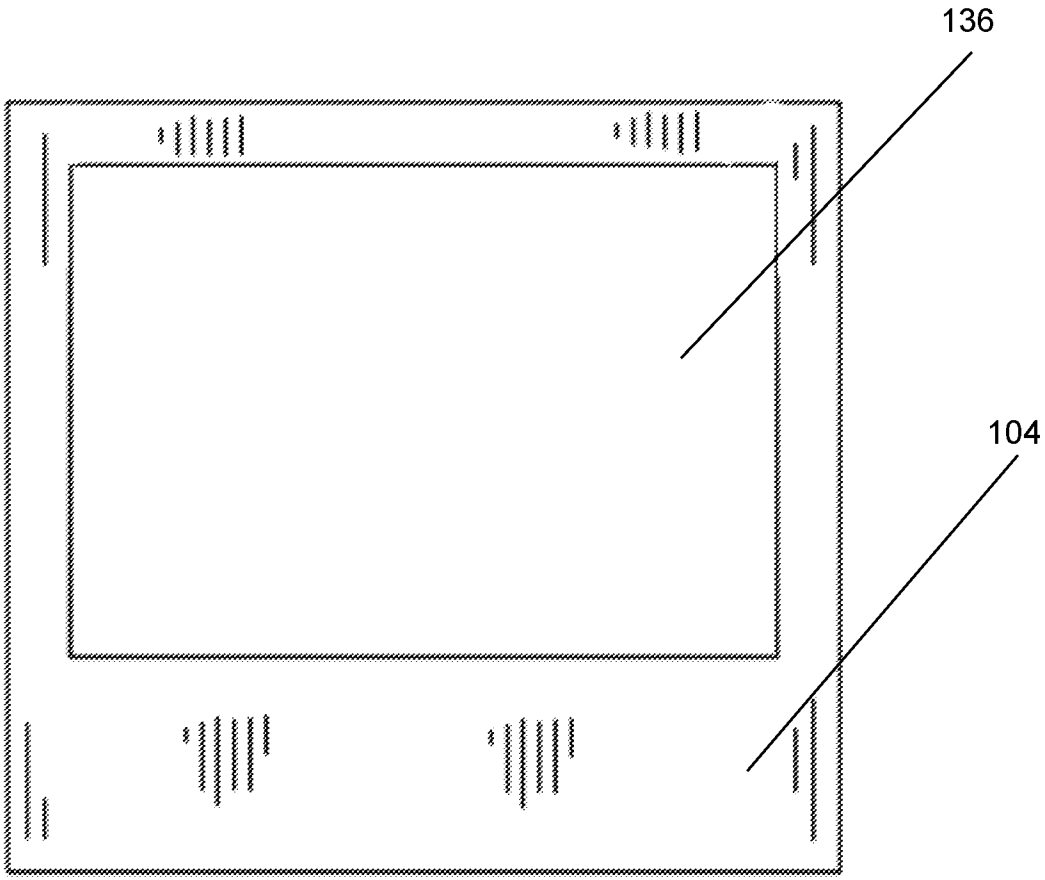
FIG. 25 shows a rear view of the yoga stool of FIG. 21.

In embodiments, the front element 103 may include an open central portion 134 (see FIG. 24). In embodiments, the rear element 104 may include a second open central portion 136 (see FIG. 25). In embodiments, the edges of these open portions may be lined with padding for comfort. In embodiments, the edges of the open portions may be covered in a material to encourage grip and reduce slipping. In embodiments, as can be seen in FIG. 25, the rear element 104 may include a top member 104*a* to fully frame the opening 136 and provide for additional structural support.

Figure 27:
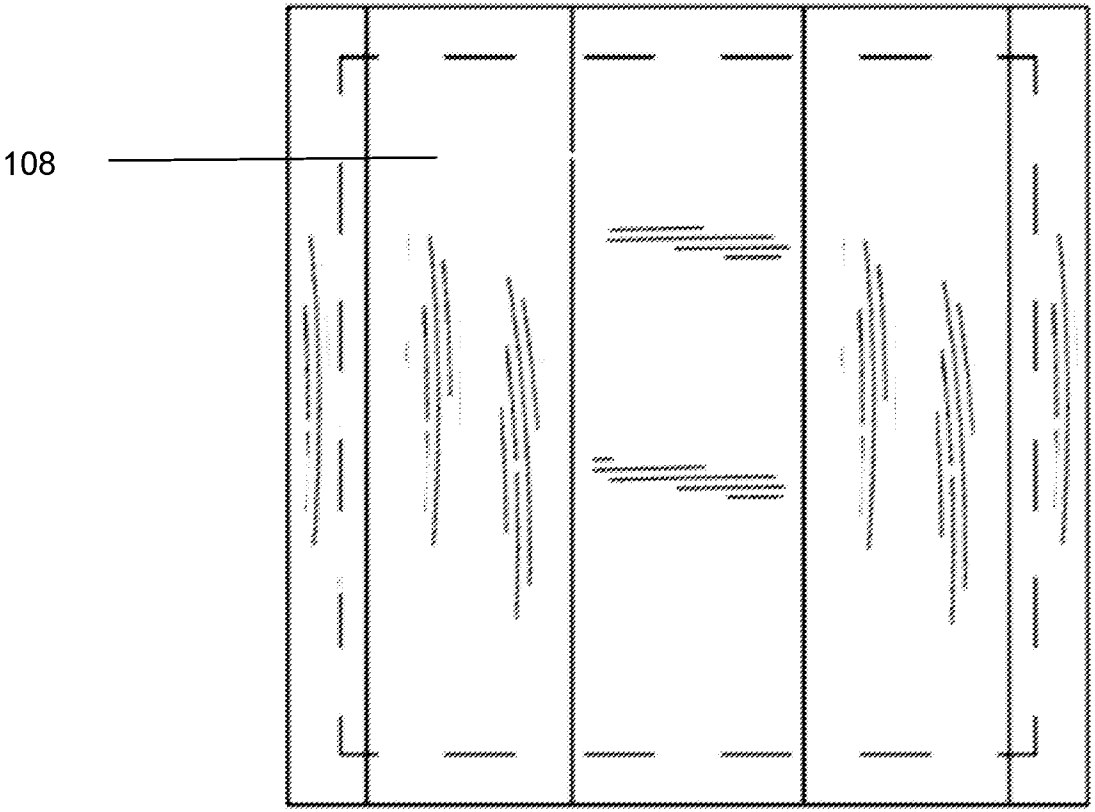
FIG. 27 shows a top view of the top of yoga stool of FIG. 22.
Figure 28:
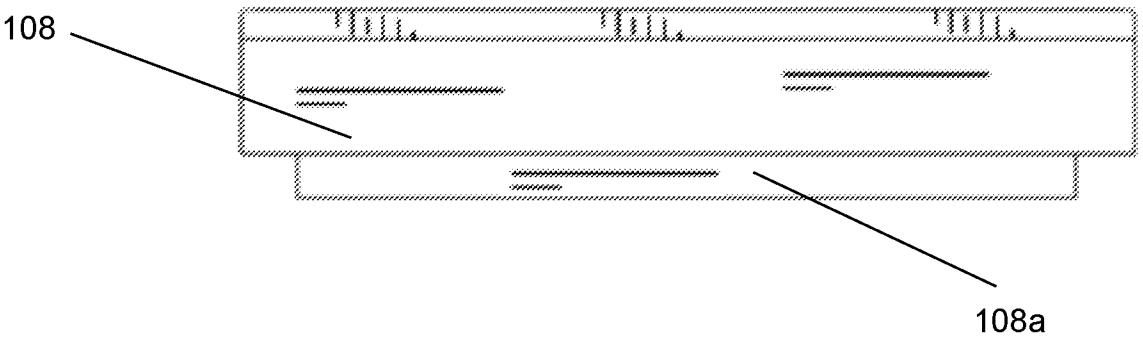
FIG. 28 shows a side view of the top of the yoga stool of FIG. 22.

As can be seen in FIGS. 27-28, in embodiments, the element 108 may be square or rectangular in shape and may include a protrusion 108*a* that extends down into the stool 101 when the top element is places thereon. In embodiments, the top surface of the top element 108 may be partially or fully covered with cushioning and/or a fabric or other cover.

Figure 29:
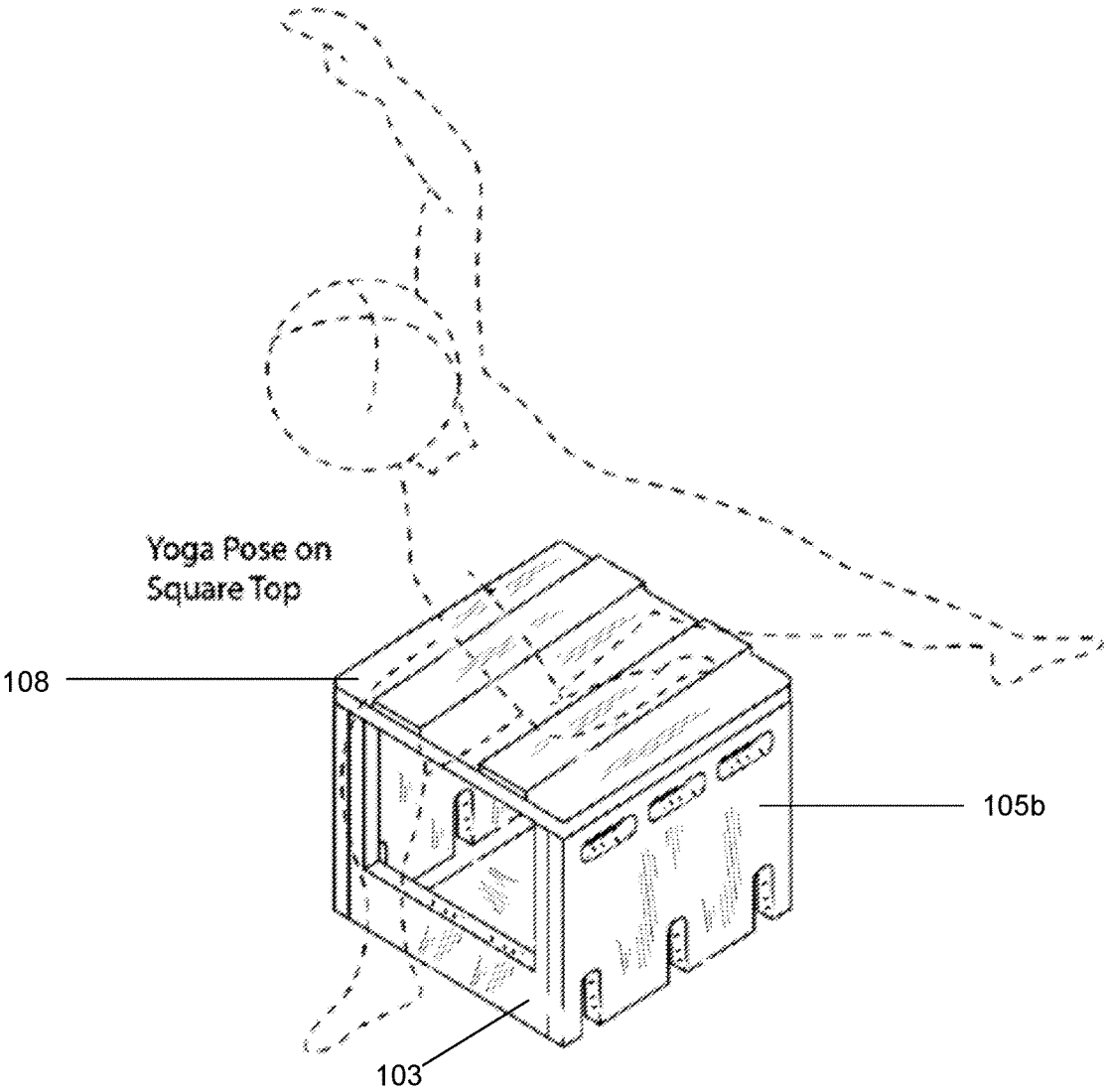
FIG. 29 shows a user interacting with the yoga stool in FIG. 22 in a selected position.

FIG. 29 illustrates an example of a user interacting with the yoga stool 101 of FIG. 22.

Figure 30:
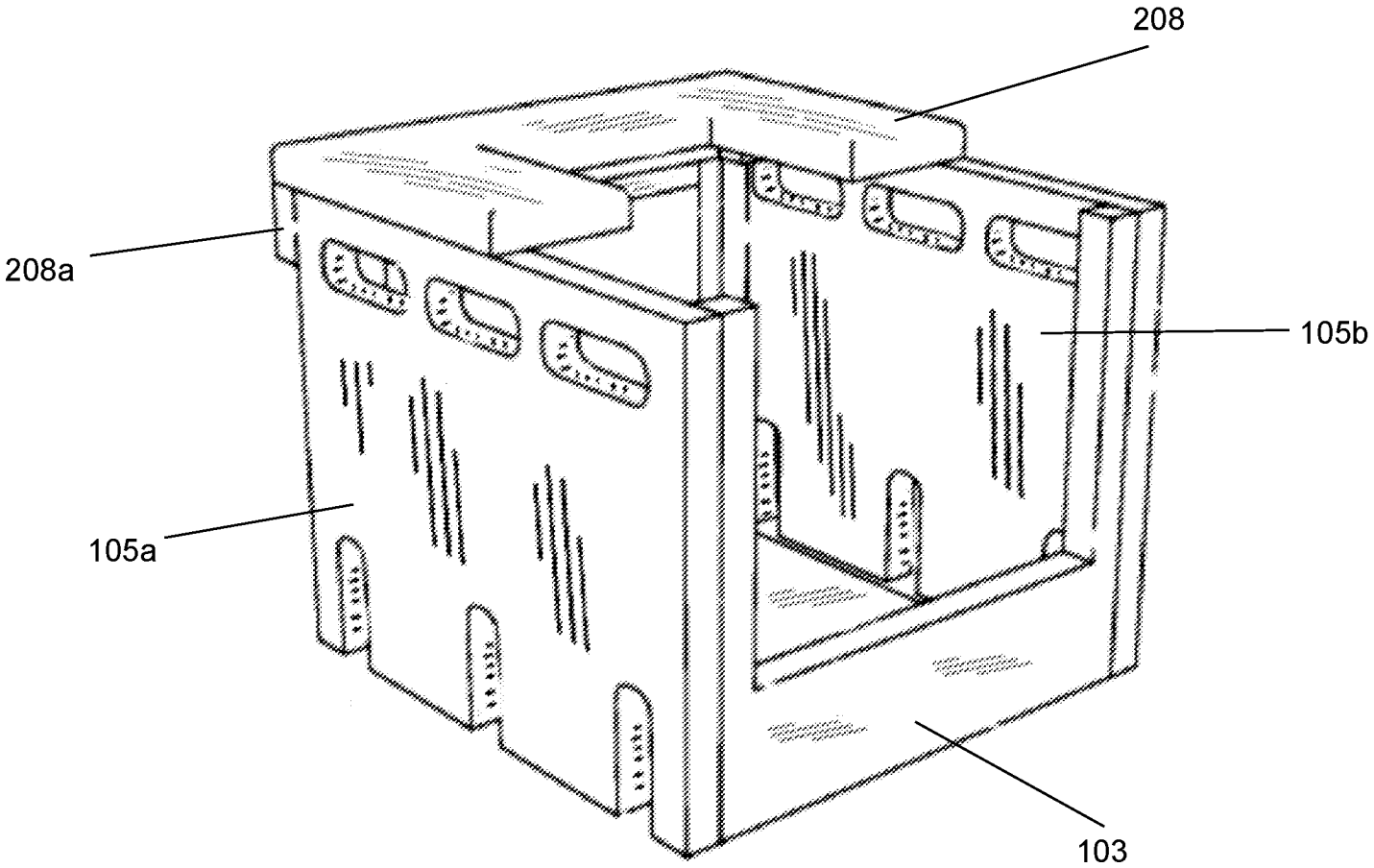
FIG. 30 shows the front perspective view of the yoga stool of FIG. 21 including an alternative top.
Figure 31:
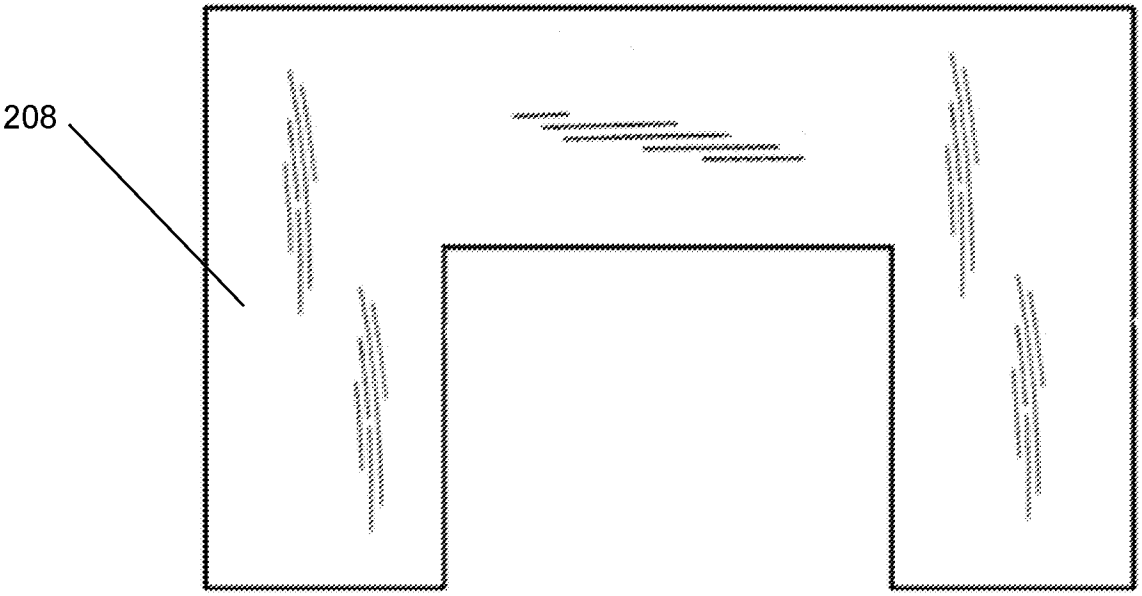
FIG. 31 illustrates a more detailed top view of the alternative top of FIG. 29.

FIG. 30 illustrates an alternative top element 208 mounted on the yoga stool 101 of FIG. 21. As may be seen in more detail in FIG. 31, the alternative top element 208 is U-shaped and does not extend all the way from the rear element 104 to the front element 103. The U-shape provides an opening to accommodate a user's head and neck in the interior of the stool 101.

Figure 32:
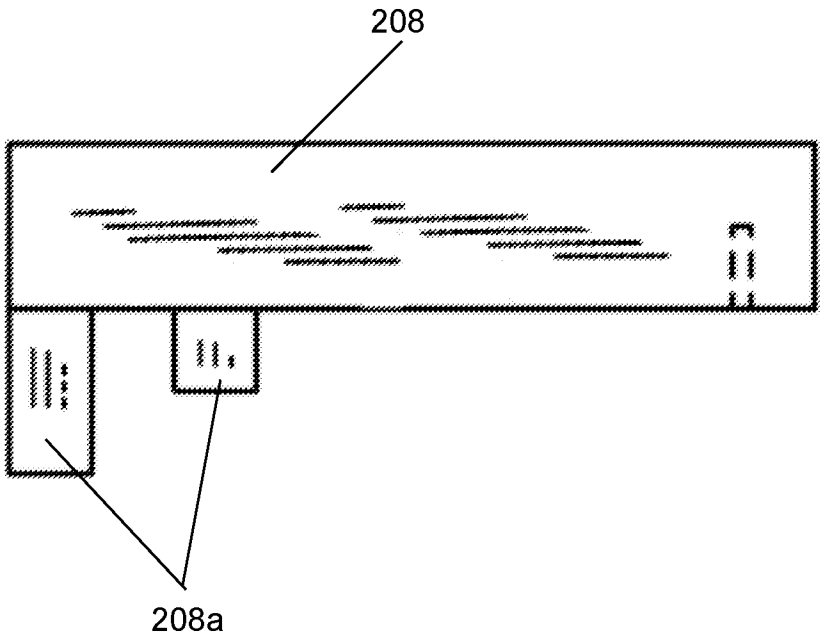
FIG. 32 illustrates a side view of the alternative top.
Figure 33:
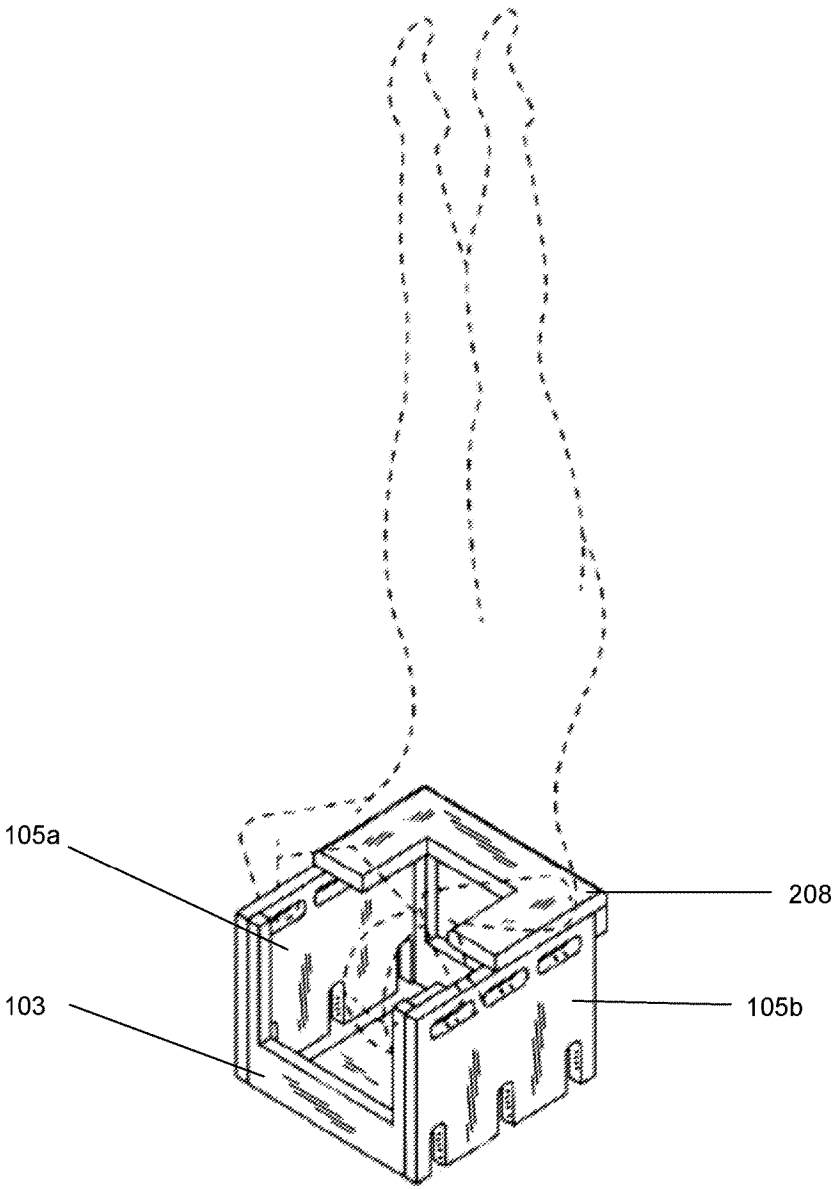
FIG. 33 illustrated a user interacting with the yoga stool of FIG. 29 in a selected position.

As can be seen in FIGS. 30 and 32, the top element 208 may include tab(s) 208*a* extending downward therefrom at a rear edge. As can be seen in FIG. 30, the tab(s) 208*a* extend outside the rear element 104 when the top element 208 is in position and help keep the top element 208 in place. FIG. 33 illustrates an example of a user performing a shoulder stand using the top element 208. In embodiments, additional structures may be provided on the top element 208 and/or on the side element 105*a*, 105*b* or the rear element 104 to provide for a connection to between the top element and the opposed side element and rear element. In embodiments, this connection allows for the top element 208 to be removed.

In embodiments, the bottom edges of the side panels 105*a*, 105*b*, rear element 104 and front element 104 may include gripping or anti-slip material.

In all of the positions illustrated, and other positions well known to those versed in yoga, but not shown herein, the stool 1, 101 enhances the user's stability. In embodiments, the stool 101 is suitable for use by users performing stretching or other exercises as well to enhance the user's stability.

The drawings are not drawn to scale. The terms "front," "rear," etc. are assigned arbitrarily for purposes of this disclosure and to label the relative arrangement of the parts, but are not to be taken as limiting the structure or possible orientations of the yoga stool in actual use.

As shown and described herein, the arrangement of the seat, the handle slots, window slots and other parts has been developed by the inventor after extensive experimentation and constitutes the best known mode of practicing the invention.

Modification and variations of the disclosed stool, including alternative arrangements of slots, windows, contact areas and hand grips, may occur to those well-versed in yoga and are considered to be within the scope of the invention.

The invention claimed is:

1. A yoga stool comprising:

a seat portion and a base portion;

the base portion having opposed top and bottom sides, opposed left and right sides, and opposed front and rear sides;

a window slot formed in at least one of the front side and a rear side;

a horizontal gripping slot formed in an upper portion of at least one of the left side and the right side; and a vertical gripping slot formed in a lower portion of at least one of the left side and the right side such that no portion of the vertical gripping slot extends above a midpoint of the at least one of the left side and the right side.

2. A yoga stool according to claim 1, wherein said base portion further comprises a handle slot formed in the upper portion of at least one of the left, right, front and rear sides.

3. A yoga stool according to claim 1, comprising at least two vertical gripping slots formed respectively in the lower portions of the left side and the right side.

4. A yoga stool according to claim 3, comprising four vertical gripping slots formed in the lower portions of the left side and the right side, two of said slots being near or at the front side and two of the slots being near or at the back side.

5. A yoga stool according to claim 4, comprising two horizontal gripping slots formed respectively in the left side and the right side.

6. A yoga stool according to claim 1, wherein the bottom side is covered with a material for gripping the floor.

7. A yoga stool according to claim 1, further comprising a massage roller mounted in said window slot and accessible from outside the base portion for massaging the feet.

8. A yoga stool comprising:

opposed left and right elements connected to opposed front and rear elements;

wherein both the left and right elements include at least one horizontal opening and at least one vertical opening;

a removable top element connected to the opposed left and right elements and at least one of the opposed front element and rear element.

9. The yoga stool of claim 8, wherein the removable top element comprises a substantially flat upper surface and extends between the opposed left and right elements and the opposed front and rear elements.

10. The yoga stool of claim 8, wherein the removable top element comprises a cushioned upper surface.

11. The yoga stool of claim 8, wherein removable top element is U-shaped and extends between the left and right elements and the rear element.

12. The yoga stool of claim 11, wherein the rear element includes an opening formed substantially in the center portion thereof and includes a horizontal support member above the opening.

13. The yoga stool of claim 11, wherein the removable top element further comprises a padded top surface.

14. The yoga stool of claim 11, wherein the U-shape is dimensioned to accommodate a user's neck.

15. The yoga stool of claim 11, wherein the U-Shape is dimensioned to allow a user's head to enter an interior of the yoga stool.

16. The yoga stool of claim 8, wherein at least one of the first and second opposed side elements include a plurality of vertical openings.

17. The yoga stool of claim 8, wherein at least one of the first and second opposed side elements includes a plurality of horizontal openings.

* * * * *